US007234897B2

(12) United States Patent
Conroy

(10) Patent No.: US 7,234,897 B2
(45) Date of Patent: Jun. 26, 2007

(54) AREA EARTHQUAKE DEFENSE SYSTEM

(76) Inventor: Vincent Paul Conroy, 3550 Pleasant Hill Rd. #917, Duluth, GA (US) 30096-4880

( * ) Notice: Subject to any disclaimer, the term of this patent is extended or adjusted under 35 U.S.C. 154(b) by 0 days.

(21) Appl. No.: 11/317,402

(22) Filed: Dec. 23, 2005

(65) Prior Publication Data

US 2006/0263152 A1 Nov. 23, 2006

Related U.S. Application Data

(60) Provisional application No. 60/643,546, filed on Jan. 13, 2005, provisional application No. 60/639,428, filed on Dec. 27, 2004.

(51) Int. Cl.
*E02D 27/34* (2006.01)
*E02D 31/08* (2006.01)

(52) U.S. Cl. ..... 405/303; 52/167.1

(58) Field of Classification Search ..... 405/303; 52/167.1, 167.2

See application file for complete search history.

(56) References Cited

U.S. PATENT DOCUMENTS

| | | | | |
|---|---|---|---|---|
| 2,417,347 | A * | 3/1947 | Brown | 188/268 |
| 3,938,625 | A * | 2/1976 | Radermacher et al. | 188/268 |
| 4,484,423 | A * | 11/1984 | McClure, Jr. | 52/167.1 |
| 4,554,767 | A | 11/1985 | Ikonomou | |
| 4,587,773 | A | 5/1986 | Valencia | |
| 4,587,779 | A | 5/1986 | Staudacher | |
| 4,651,481 | A | 3/1987 | Czak | |
| 4,793,105 | A | 12/1988 | Caspe | |
| 5,056,280 | A | 10/1991 | Shustov | |
| 5,174,082 | A * | 12/1992 | Martin et al. | 52/167.2 |

(Continued)

FOREIGN PATENT DOCUMENTS

| | | | |
|---|---|---|---|
| JP | 01182473 | A * | 7/1989 |

(Continued)

OTHER PUBLICATIONS

Joseph Carleone, "Mechanics of Shaped Charge Warheads"; *Tactical Missile Warheads*; vol. 155 in book series by American Institute of Aeronautics and Astronautics; 1993; AIAA; Washington, DC; pp. 315-320.

*Primary Examiner*—John Kreck
(74) *Attorney, Agent, or Firm*—Alston & Bird LLP

(57) ABSTRACT

An area earthquake defense system is disclosed which uses military planning principles; automated command and control systems; the technology of wave manipulation demonstrated in optical engineering, sonar, and anti-tank weapons and their countermeasures; and proven electromagnetic technology. Deeply buried, specially configured, passive devices attenuate, temporally segment, and redirect earthquake shock waves. Such a system, fully integrated into the local geological structure, can reduce the shock reaching the protected area, and, within that area, channel it away from those structures most difficult to protect with single point measures. This is especially true when the plurality of passive devices is complemented by an automated decision and command loop and dynamically reconfigurable active devices embedded at a variety of depths. Further, within the defended areas those structures enhanced with electro-magnetic levitation systems can be raised from their bases and, by partial or full decoupling, isolated from the shock. Structures with electromagnetic motion control systems can further be protected by having a means for controlling their displacements during the earthquake and for restoring them to their original location on the site despite any lateral translations experienced during the event.

30 Claims, 17 Drawing Sheets

U.S. PATENT DOCUMENTS 5,726,637 A 3/1998 Miyahara et al.
5,800,078 A * 9/1998 Tommeraasen ..... 405/302.5
5,910,763 A 6/1999 Flanagan
5,984,062 A 11/1999 Bobrow et al.
6,115,972 A 9/2000 Tamez
6,130,412 A 10/2000 Sizemore
6,293,530 B1 9/2001 Delorenzis et al.
6,321,492 B1 11/2001 Robinson
6,347,374 B1 2/2002 Drake et al.
6,499,170 B2 12/2002 Kim et al.
6,518,878 B1 2/2003 Skoff
6,560,991 B1 5/2003 Kotliar
6,581,340 B2 6/2003 Orovay et al.
6,659,691 B1 12/2003 Berry
6,675,539 B2 1/2004 Shreiner
6,792,720 B2 9/2004 Hocking

FOREIGN PATENT DOCUMENTS

JP 09318762 A * 12/1997
JP 2000160577 A * 6/2000

* cited by examiner

AREA EARTHQUAKE DEFENSE SYSTEM

CROSS-REFERENCE TO RELATED APPLICATIONS

This patent claims the benefit of provisional patent applications Ser. No. 60/639,428 filed 27 Dec. 2004 by the present inventor and Ser. No. 60/643,546 filed 13 Jan. 2005 by the present inventor.

FEDERALLY SPONSORED RESEARCH

None

SEQUENCE LISTING

None

BACKGROUND OF THE INVENTION—FIELD OF INVENTION

This invention generally relates to the field of earthquake defense, specifically the use of area-wide, integrated defense systems throughout the surface and subterranean extent of the defended area and, as necessary, at locations outside the area.

BACKGROUND OF THE INVENTION—PRIOR ART

When a military operation is to be conducted the area of battle is normally delineated on a map by marking its boundary. Fighting the enemy within the boundary is primarily the responsibility of the commander of the ground forces within the unit, supported by organic and external fire support. It is a major responsibility of the overall operation commander to seal off the battle area, filtering external support to the enemy engaged therein, and essentially feeding the enemy to the friendly forces within the area in manageable portions.

In a somewhat similar fashion, when bombers were sent over Europe in WW II they had their best survivability when escorted by fighters. The latter would do as much as possible to cut the enemy fighter force down to size or at least tie them up so that the defensive gunners in the bombers did not have so difficult time dealing with the threat.

The standard doctrine is to weaponize the targets themselves so they can provide for their own individual defense and then to do everything possible to prevent the enemy from reaching them in strengths beyond what they can withstand.

In general this philosophy has not been applied to earthquake defense, although earthquake protection has been the subject of numerous inventions. These advances may be grouped into six general categories as follows:

1. Measurement Techniques and Analytical Methods
2. Hardening for Items of Furniture or Fixtures
3. Structural Protection by Physical Barriers and Soil Manipulation
4. Structural Protection by Frame Hardening, Damage Resistance, and Blow-out Walls
5. Structural Protection by Structural Movement and Acceleration Compliance with or without Shock Absorbers
6. Sensors, Alarms, and Control Systems With the exception of Measurement Techniques and Analytical Methods there are three basic shortcomings of these approaches. The first is that they tend to be oriented to individual structures or small groups. The second is that they tend to be limited to surface or shallow depth application. The third is that the range of responses is very limited. Even the control systems that recognize the importance of external communications and networking and those that can issue commands to remote devices envision a very limited set of responses. Automated decision making is envisioned at only the most basic level. Therefore with respect to an area such as Southern California as a whole these approaches represent a patchwork approach which leaves each structure to face the physical onslaught alone. While single site defenses are absolutely necessary, better results will be achieved if the shocks impinging a single point have been reconfigured for minimum effectiveness against the structure's defensive characteristics.

A brief review of the prior art with respect first to structural protection by physical barriers and soil manipulation; then structural protection by structural movement and acceleration compliance; and finally sensors, alarms, and control systems will illustrate limitations that can be removed or reduced.

With respect to physical barriers and soil manipulation four patents are relevant.

In U.S. Pat. No. 6,581,340 (2003) Orovay et al disclosed a design and building technique wherein the foundation of a structure would reside on an in-ground, modular base assembly consisting of two layers of modules separated by a deformable layer of materials. For economy they included a variety of readily available materials such as old tires and granular materials enclosed in suitable enclosures. This is a very simple and totally passive system that works to protect only one structure at a time; only operates in very shallow depths; and has very limited value in protecting the larger structures which characterize urban settings.

In U.S. Pat. No. 4,484,423 McClure, Jr., (1984) disclosed a seismic shield consisting of a generally vertical trench at least 100 meters (328 feet) deep and oriented between the structure to be protected and the source of earthquake shocks. The trench might be open to the air or covered. The trench would be filled with low shear modulus material such as a liquid. Other materials identified included the open air itself and a variety of slurries, gels, solids, and gasses. The trench might have a wall on one side extending as deep as 1,000 meters (3,280 feet). McClure, Jr., postulated that such a structure would inhibit the transmission of seismic waves, especially S waves. S waves shake the ground laterally or vertically to the direction of propagation and are more destructive than the other type of body waves, P waves, which are compressive. The limitations with this invention are that in some areas a building would require virtually a circular mote to fully protect it from known and possible sources. In an urban environment construction of such a barrier may be impossible without significant demolition first. It would provide no protection against body waves arriving directly from causative faults beneath a city or with a direct line to the city under the trench. Depending on the specific design, it may not provide much protection against compressive P waves. Also the barrier is static with fixed characteristics. Lastly the maintenance of such a structure might be rather much. Uncovered standing water tends to grow micro organisms and become foul. Any chemicals added to the water to prevent such action would have to be chosen for non-corrosive actions and economy. On the other hand recycling the water periodically would likely put a strain on local resources, especially if there were a number of these structures. A fully buried mote structure, as provided for, would alleviate much of this issue, but fully encapsulated water might transfer compression waves very effectively.

In U.S. Pat. No. 5,174,082 (1992) Martin et al disclosed the use of a plurality of islands installed around structures to be protected. They offered two general types. The first was compressed earth held between an anchor at 5 to 30 meters (16.4 to 98.4 feet) depth and a sole, or plate, on the surface. The two end devices would be connected by a connecting means under tension. The second type of island envisioned the use of wells or similar vertical openings either unlined or lined with concrete and filled with a variety of materials. In both types of structure the object was to create a maze of vertical structures whose mechanical characteristics would be different from the rest of the ground to a result that impinging seismic waves would be attenuated. The limitations of the approach are that it operates in a very shallow range, 30 meters (98.4 feet) or less. In setting that depth Martin et al do make note of studies that indicate that this is the depth within which the mechanical properties of the surface layer have their most effect on earthquake propagation. Another limitation is that it is very much oriented on single structures. A final limitation is that it is a static structure.

Berry in U.S. Pat. No. 6,659,691 (2003) discloses an approach in which a plurality of underground piles in multiple rings and depths interacts to perform two important functions at once: to reduce the tendency of the soil under a structure to liquefy and to improve deflection and dissipation of the incident shock waves. There are seven perimeters specified with 5 and 18 piles per perimeter, and their orientation is generally divided into one set at 12 to 20 degrees and another at 30 to 60 degrees. Multiple types of materials are identified as candidates for the structure, and depths of 7.6 meters (25 feet) or more are prescribed. The limitations here are similar to those of Martin et al's approach: single structure, shallow depth, and fixed structure.

With respect to structural movement and acceleration compliance literally dozens of patents can be cited.

A limited sample includes Delorenzis et al, U.S. Pat. No. 6,293,530 (2001); Kim et al, U.S. Pat. No. 6,499,170 (2002); Shreiner, U.S. Pat. No. 6,675,539 (2004); Ikonomou, U.S. Pat. No. 4,554,767 (1985); Valencia, U.S. Pat. No. 4,587,773 (1986); Staudacher, U.S. Pat. No. 4,587,779 (1986); Csak, U.S. Pat. No. 4,651,481 (1987); Caspe, U.S. Pat. No. 4,793,105 (1988); Shustov, U.S. Pat. No. 5,056,280 (1991); Bobrow et al, U.S. Pat. No. 5,984,062 (1999); Tamez, U.S. Pat. No. 6,115,972 (2000); and Robinson, U.S. Pat. No. 6,321,492 (2001). In general the advances documented involved moving joints, special bearings, advanced isolation techniques and mechanisms, active and passive vibration dampening, liquid springs, and other electro-mechanical approaches. Each one, however, displays at least one of the following limiting characteristics: limited range of motion for components or structures; designs that are difficult to integrate with traditional styles and structures; intrusive bulkiness; limited ability to be integrated with a defensive command and control network and to be remotely, dynamically controlled; or limited ability to be upgraded and modernized as technology advances.

In Sensors, Alarms, and Control Systems six patents illustrate the limitations.

In U.S. Pat. No. 5,726,637 (1998) Miyahara et al disclosed a system for automatically protecting building occupants at all times and in an economical way. First, two separate sets of sensors would be used to detect and confirm earthquakes. The reason for using two separate sets was to have independent corroboration in order to avoid false alarms. The result of the detection focused primarily on activating protective measures internal to occupied structures whereby people would automatically be protected from flying or falling debris. These measures involved inflating rapidly expanding structures to form barriers. Thus it was a passive system triggering an active but very localized defense.

Three separate patents and inventors (Drake et al, Flanagan, and Skoff) have laid down plans for collecting and analyzing sensor data, determining that earthquakes have or have not occurred, and carrying out various responses.

Drake et al in U.S. Pat. No. 6,347,374 (2002) outlined a system for event detection using networks of sensors, computers, dynamically updated databases, secure networks, and decision rules including rule-based processing and statistical processing. The output was to provide data to the human safety authorities so they could better deal with the problem.

It was a comprehensive and detailed look at how to manipulate raw data to constantly enhance earthquake detection and characterization, but the output was very limited.

Similarly Flanagan provides a very comprehensive description of data sources, networks, and reporting channels and agencies in U.S. Pat. No. 5,910,763 (1999). He also shows a method by which general alerts can be issued to large areas but detailed follow up information and evacuation instructions can be restricted to only those in the areas most affected. He also indicates that certain predetermined responses could be triggered such as to closing valves on pipelines and executing similar controls on electrical grids, for example.

Skoff adds further details in a complementary vein of a multi-event alerting system. In U.S. Pat. No. 6,518,878 (2003) he describes a system that can take reports from smoke detectors, earthquake detectors, gas detectors, and then determine the correct array of reports and alarms to activate.

What none of these systems does is actively fight the earthquake as a response; they sound alarms and execute limited predetermined activations. Two other patents take limited steps in the direction of active defenses.

In U.S. Pat. No. 6,130,412 (2000) Sizemore discloses a method and apparatus for remotely controlling devices in response to a detected condition. This expands on the responses alluded to by Drake et al, Flanagan, and Skoff. Essentially he establishes a servo relationship of a remote actuator to a detection and response system. The main beneficial result of this device is in the interruption of fire-causing conditions and materials and the control of similar damage and danger. Other patents have used local sensors to activate valves and similar controls; Sizemore does it remotely.

In U.S. Pat. No. 6,792,720 (2004) Hocking utilizes sensors, embedded electrical wires, a direct current power source, the local soil and water conditions, and the process of electro-osmosis to create a subsurface propagation inhibitor. In an area where the soil is a very fine type of clay, sand, slurry, or similar material he prescribes utilizing a subsurface layer near enough to the water table that DC power routed through the silt will draw the water table up and liquefy the layer. This will provide a seismic disconnect between the surface and any rising shock waves, an active defense. He also describes another set of circuits for reversing the situation and eliminating the liquefaction. When appropriate, he recommends the use of a standby water supply. The limitations seen in this approach are that it is not clear that this is intended to cover more than a small area; it is employed at a shallow depth in favorable soil and water conditions; and that in places where such benign conditions are absent the volume of water needed or the challenge of delivering it in a timely manner may be prohibitively expensive. This is besides the fact that shock induced soil liquefaction is one of the major damage mechanisms of an earthquake, so intentionally inducing such must be done with extreme care.

BACKGROUND OF INVENTION—OBJECTS AND ADVANTAGES

Accordingly, besides alleviating the shortcomings of the prior art, several objects and advantages of the present invention are:

(a) to provide a defense that will protect a large area with emphasis on reducing the destructive power of the overall shock waves reaching the surface to M4 on the Richter scale or less and in particular to focus on reducing the damage capabilities for shocks impinging those structures hardest to defend using single structure techniques;

(b) to provide as a part of that system a wholly passive, fully integrated defensive maze that will at all times reduce the shock wave reaching individual structures on the surface with no outside intervention, command, power, or support;

(c) to make such a complex able to respond immediately to successive tremors of all waveforms and intensities with minimal or no repair, refurbishment, or replenishment;

(d) to provide active devices that the command and control system can configure and reconfigure as necessary to optimize the overall attenuation, redirection, and transformation of the earthquake shock waves and, uniquely, to prevent harmonic accumulations;

(e) to provide a single structure defense that is compatible with current structural design practices and which will not introduce intrusive structures;

(f) to provide a single structure defense which employs features amenable to continuing improvement and benefiting from the introduction of new technologies in such growth fields as electromagnetism, super-conductivity, friction reduction technology, and automated control systems;

(g) to provide a single structure defense which allows for different levels of protection to accommodate different financial budgets during the installation and for different levels of electrical power available at any moment during the event;

(h) to provide a single structure defense mechanism inherently compatible with internal or external data transmission systems and command networks, including command and control networks;

(i) to provide a single structure defense based on electromagnetic levitation that utilizes the principle of "just enough lift" (JEL) to allow at least some defensive motion of the defended structure even when insufficient electrical power is available to a single site to support a complete set of responses;

(j) to provide a single structure defensive system that can allow dislocation of the structure in an overload condition and also support relocation of the structure after the cessation of the earthquake event;

(k) to provide an automated command and control system that will manage the defense system; collect and analyze reports; make decisions within the timelines necessary for effective response; reconfigure, arm, and fire selected devices of the defense as necessary to tune the system response during the earthquake event; execute the measure-predict-calculate-activate defenses cycle iteratively until the tremors have ended; deal with multiple near-simultaneous earthquakes on a systems basis; and to interface with all appropriate human command and control systems.

SUMMARY

In accordance with the present invention the system comprises a plurality of physical and electronic devices deployed within the defended area and elsewhere as necessary at various depths from the surface and its structures to the fault lines, which may be 70 kilometers (43.4 miles) or more below the surface, including wave shapers for the redirection or temporal segmentation of the shock waves; dissipation chambers for the dissipation and neutralization of the shock waves; single structure and single site defenses based on electro-magnetic levitation and propulsion and integrated with other structural defenses; and a fully automated command and control system.

The single structure system comprises a plurality of electro-magnetic levitation and propulsion devices with dynamic computer controls or presettable controls to provide active, controlled isolation. Specifically it provides the ability of structures to decouple themselves from their steady state supports and perform escape maneuvers. These involve levitation above the foundation, either passively riding out the shock waves with no attempt to control drift relative to the original spot or, by a combination of lift and propulsive actions, to levitate and to maneuver as needed. In either case the minimum standard of success is decoupling the structure from the foundation enough to avoid earthquake damage to the structure and friction or impact damage to the weight bearing surfaces between the structure and its foundation. The term single site connotes several structures joined by a common command and control system or shared electrical power systems or a combination of the two.

DRAWINGS—REFERENCE NUMERALS

Figure 1:
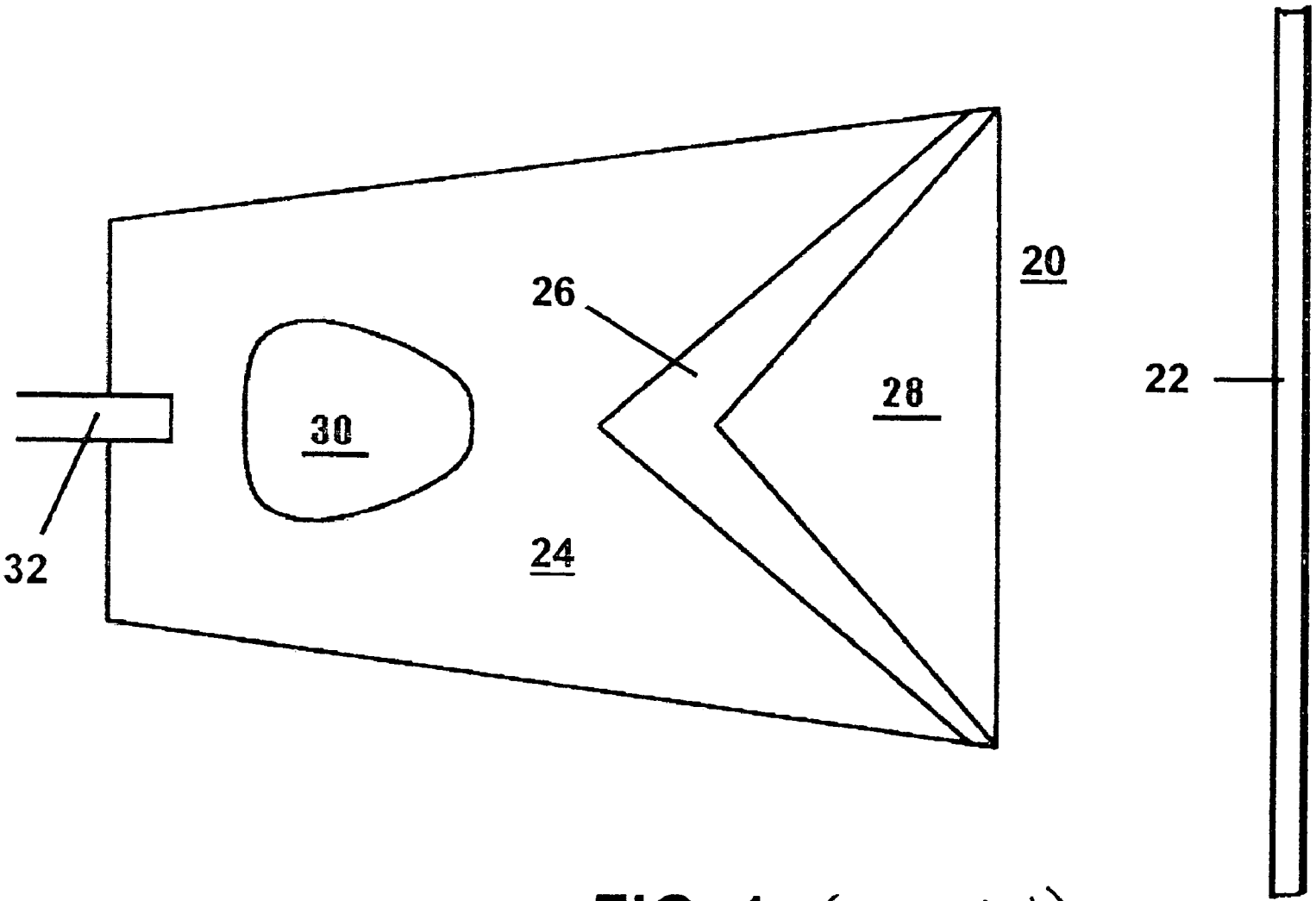
FIG. 1 (Prior Art)
FIG. 1 depicts a nominal cross section of a shaped charge warhead.

20 large, open end of the copper liner for a shaped charge warhead
22 target
24 main explosive charge
26 copper liner
28 hollow interior of shaped charge
30 wave shaper
32 initiator train including primer
34 shock wave created in the initiator train
36 initial shock wave created in the aft end of the main charge
38 center portion of the shock wave slowed dramatically and falling aft of the outer ring
40 outer ring of the shock wave moving forward in a toroid
42 liquid copper ejected from the liner walls by the energy of the shock wave
44 copper slag ball
46 molten copper stream traveling at Mach 25
48 point of impact of copper stream on target
50 spall crater on inside surface of target armor
52 radiating cloud of spall
54 initial wave vector
56 medium of travel for initial wave vector
58 different material
60 refracted wave vector
62 light vector incident to prism
**62*a*-62*d*** light wave broken into component wavelengths by prismatic refraction
64 upper layer of ocean
66 lower layer of ocean
68 thermocline
70 sonar transmission from surface ship
72 sonar waves reflected and refracted away from deep water
74 sonar waves refracted into deeper water
76 sonar shadow zone with submarine in hiding
78 light ray incident to a prism
80 reflected ray
82 reflected ray
84 wave incident to a grating
86 grating plate
88 iris
90 emergent, diffracted wave
92 oncoming earthquake shock wave
94, 96 outer portions of shock wave
98 center portion of oncoming earthquake shock wave
100 defended area
102 refractor vessel
104 refractor fill material
106 approach end of the earthquake shock channel
108 incident shock wave
110 wave refracted toward safe direction
112 defended area on the surface
114 shock disperser
116 line or assembly of shock reflectors in spine of refractor
118 top cap of non-transmissive materials
120 refractor vessel
122 shock reflectors
124 refractor fill material
126 incident earthquake shock wave
128 refracted portion of shock wave
130 defended area
132 dissipation chamber
134 liquid
136 gas
138 artificial spall
140 compressive P wave
142 translational S wave
144 dissipation chamber vessel
146 fluid reservoir
148 counter shock generator—transmitter
150 non-transmissive cap
152 passive dissipation chamber
154 active dissipation chamber
156 wave shapers
158 defended area
160 sky scraper district
162 electro-magnetic coil assembly
164 wall
166 electro-magnetic coil assembly
168 foundation to which wall is attached
170 male connector assembly in location coupler
172 female connector assembly in location coupler
174 location pin
176 receptacle for location pin
**178*a*, 178*b*** electro-magnetic horizontal motion control coils
**180*a*, 180*b*** electro-magnetic horizontal motion control coils
182 earthquake shock wave
184 time $t_0$
186 deployed subsystem of the command and control system
188 main command and control center
190 sensors and reports to the system
192 communications bus
194 local command and control systems
196 Automated Command and Control System
198 time $t_1$
200 establishment of emergency posture
202 passive defenses reducing and changing the shock
204 active defenses reducing and changing the shock
206 time $t_2$
208 activation and execution of active defenses
210 time $t_3$
212 earthquake residuals act on the defended area
214 time $t_4$
216 recover and reconstitute phase

DETAILED DESCRIPTION OF THE PREFERRED EMBODIMENT

What can be done to apply in an area earthquake defense the military technique of cutting the enemy down to size before he gets within range of his targets? An integrated defense can be mounted from the surface to significant depths within which the mechanism of each device and its effects are implemented to maximize the overall reduction in damage and injury.

Relevant Parameters

Two key characteristics of such a defense are extraordinary speed of operation and the ability to reduce earthquakes larger than 4 on the Richter scale to levels at or below that level in selected areas. Reducing earthquakes to M4 or lower makes them to be much more within the defensive capabilities of traditional earthquake resistance design practices for buildings, roads, and other structures.

Such a defense must be extremely fast because most dangerous earthquakes occur within 60 km (37 miles) of the surface and the area to be defended may be right over the causative rupture. Most of the California faults are within 15 km (9 miles) of the surface. Earthquake waves can travel at speeds up to 5.7 km per second (3.6 miles per second) in granite; from rupture to arrival of the shock in a site of interest can occur in less than a minute even for causative faults at some remove. The present invention uses the nature of the shock waves and the geological characteristics of the area to passively manipulate the earthquake shock in multiple ways even as it advances. The degree of reduction reflects the extent to which the affected governments and owners elect to install the devices needed.

Earthquakes present at remote sites in four different wave forms, each of which must be considered in designing the defense. Two forms are created at the rupture, P waves and S waves. These are called body waves, and they radiate in all directions throughout the earth. When body waves hit the surface they create the other two forms, Rayleigh and Love waves. Rayleigh and Love waves, unlike body waves, are strictly bound to the surface and are called surface waves.

Shock wave transit times depend on the materials to be transited and the nature of the waves. In general, all other things being equal, wave speeds are higher in material with higher rigidity, and they are lower in material that is denser. The velocity of sound, for example, in sand is 244 meters per second (800 feet per second) or less but in solid granite 6,100 meters per second (20,000 feet per second) or more.

P waves are called primary waves. They are also called pressure waves and longitudinal waves. A P wave compresses and elongates along the axis of travel. It is an acoustic wave, and under some conditions the highest frequency P waves can be heard at the bottom of the human hearing range, approximately 20 hertz. They are the fastest of the wave forms, traveling at approximately 5.7 km per second (3.6 miles per second) in granite, and from the site of the rupture they will travel to the surface both directly and by routes through the earth. P waves can cross liquid, so they are not stopped by the molten core of the earth.

S waves are secondary waves. They are also called translational waves. In S waves the amplitude moves forward in sine waves at right angles to the line of advance. S waves in the vertical plane are called S-V, and S waves in the horizontal plane are called S-H. S waves, like P waves, are created at the focus of the earthquake and travel both directly and indirectly to the surface. Unlike P waves, S-H cannot penetrate liquid and cannot cross the core of the earth. S waves travel at about 3.1 km per second (1.9 miles per second).

Rayleigh waves are formed by the intersection of P waves and S-V waves with the surface. Rayleigh, or R waves, demonstrate the vertical amplitude of S-V waves and the fore and aft motion of P waves in a manner very similar to ocean waves. R waves travel at about 2.7 km per second (1.7 miles per second), and they can cross liquid.

Love waves, or L waves, are formed by the intersection of S-H waves with the surface. They exhibit a strictly side-to-side motion in the displacement as they pass. L waves are somewhat faster than R waves, but, like S-H waves, they cannot penetrate liquid.

A typical sequence of observations at an earthquake site is a bang as the P wave arrives, followed shortly by vertical and horizontal displacements from the S waves, and then vertical, horizontal, and longitudinal effects from the surface waves.

The relative contribution of energy for the four types will depend on whether surface waves will be prominent. In general the lateral shocks are the most destructive. P waves have only about ⅓ to ⅔ of the acceleration amplitudes of S waves, plus they have shorter durations. When surface waves are strong the L waves are particularly important for their impact on foundations. The hypocenter is the site of the fault, and the epicenter is the surface area directly over the fault. The ratio of the lateral distance of the defended area from the epicenter to the depth of the hypocenter will determine whether surface waves will be significant. For relatively near quakes, where the distance from the epicenter to the point of interest is less than five times the depth of the hypocenter below the epicenter, the amplitude of Rayleigh waves is considerably lower than those of the body waves. For a defended area directly above the causative fault the directly transiting body waves will predominate.

Several relationships exist with regard to the power of earthquakes. In general the longer the fault, the greater is the energy release, the greater are the accelerations seen in the shock waves, and the longer is the duration of the shock pulses. The level of destructiveness is reflected in the acceleration pulse area, the product of the acceleration curve and the duration. The acceleration pulse area is denoted in feet per second. M5 earthquake accelerations may be on the order of 0.09 g and their duration on the order of 2 seconds. M7 earthquakes may have accelerations on the order of 0.37 g's and durations of up to 24 seconds. The 1906 San Francisco earthquake, for example, is reported to have had a duration in excess of 40 seconds in the primary shaking. The fact that the pulse area is so important probably reflects the need to allow sufficient time for the forces to integrate upon the structures encountered. Too short an integration time in some applications will result in the energy having passed over the object before there has been appreciable absorption.

Earthquake effects are measured in three parameters at the same time: accelerations, velocities, and displacements. All three of these are greatly affected by the characteristics of the ground. All other things being equal, speeds increase in rigid materials and decrease in very dense materials. Material which is not dense may be displaced more than denser material, and unconsolidated deposits actually exhibit an amplifier effect with respect to displacement when struck by shock. As the transition from granite to unconsolidated material occurs the wave speed slows and the ground motion greatly increases. Thus the size of defensive structures meant to interfere with the shock wave will depend on exactly where they are sited and what are their specific missions. Such dimensions can be predetermined, however, given the specific requirements.

Underlying Proven Techniques

Techniques for the control of pressure and translational waves are well understood and include reflection, refraction, diffraction, and absorption. Physical systems that demonstrate the techniques involved include shaped charge, anti-tank warheads; optical prisms; sonar systems; and diffraction gratings.

Shaped charge warheads provide illustrations of two mechanisms: passive control of extremely high speed shock waves and the dissipation of shock energy by passively converting it into kinetic and thermal energy.

The most widely deployed anti-tank warhead is a shaped charge warhead with a hollow, conical, copper liner. FIG. 1 illustrates. The big end of the cone 20 faces the target 22, and the main explosive charge 24 is wrapped around the outside of the copper cone 26. The interior of the trumpet 28 is empty, which is why this type of device is also called a hollow charge. At the aft end of the main charge is a very dense, inert device called a wave shaper 30. Lead is a popular material for wave shapers. Aft of the wave shaper and pointed straight at the main charge is the initiator train 32 containing the primer assembly.

In order for the warhead to function properly the shock wave created when the initiator charge is detonated must be applied to the aft edges of the main in a near perfect toroid, or ring. The shock wave from the initiator travels the 15 cm (six inch) (or shorter) length of the initiation train at about 4.8 to 8 km per second (3 to 5 miles per second), depending on the explosive. This is in approximately the same speed range as earthquake waves, which, as noted, travel at speeds from 3.1 to 5.7 km per second (1.9 to 3.6 miles per second), depending on the wave form and the density of the strata.

Figure 2:
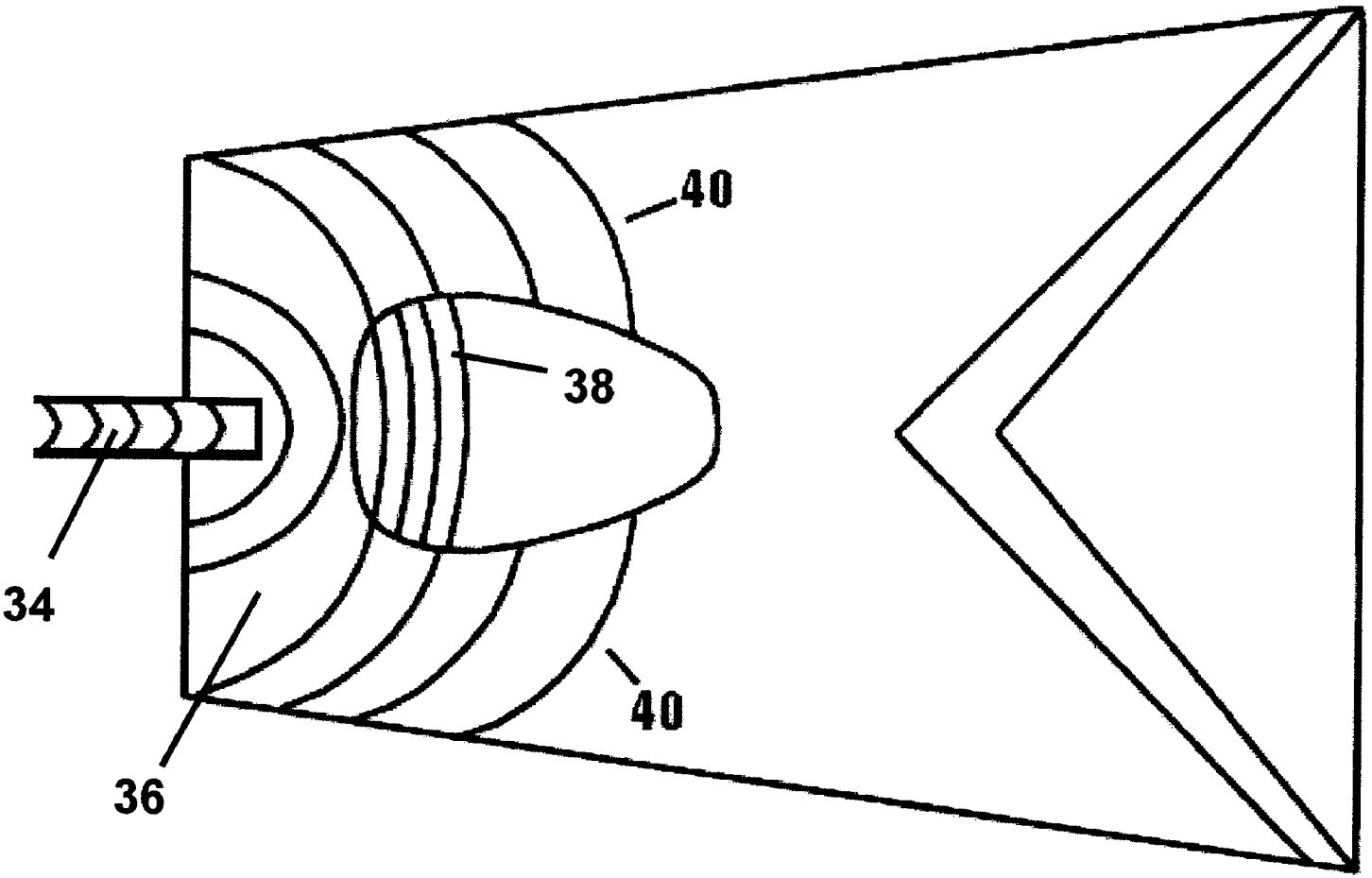
FIG. 2 (Prior Art)
FIG. 2 shows how a wave shaper converts the hemispherical shock wave into a fast-moving, toroidal shock wave which is trailed by a residual, slow-moving, central shock wave component.

FIG. 2 illustrates how this is accomplished. Detonation of the initiator chain causes a detonation wave to run forward 34 and detonate the main charge at its apex. Due to the active process within the detonation wave, the detonation wave is not a shock wave as strictly defined in aerodynamics and hypersonic analysis. Seismological techniques, however, have proven that shock propagation from explosive events and earthquakes generally follow similar principles. Therefore the detonation wave will hereinafter also be referred to as an explosive shock wave.

The face of the wave takes the shape of an expanding hemisphere 36. It runs straight into the wave shaper. The wave shaper is not wide enough to block the whole blast wave, but it is wide enough to block the center of the wave. Upon striking the wave shaper the center of the wave is slowed so dramatically 38 that it is effectively eliminated from the timeline for the detonation of the main charge. The center portion does not get absorbed or disappear; it just doesn't complete its trip through the wave shaper until it doesn't matter any more. By hobbling the center of the shock wave the wave shaper changes the propagation formation into two energy entities: an extremely fast, forward moving toroid 40 that impinges the main charge at the periphery of the apex perfectly and a slower moving one which will still be transiting at the point in time when it no longer matters.

The effectiveness and reliability of shaped charge warheads and the surety of these design techniques have been proven repeatedly since World War II. They form the basis for virally all the infantry and helicopter launched anti-tank weapons in the world. The helicopter launched missile upon which both the U.S. Marine Corps and the U.S Army relies, AGM-114 HELLFIRE, uses a shaped charge with an inert wave shaper to control the initiation of the main charge as described herein. Over 60,000 of these missiles have been procured at a cost of over $1,000,000,000, and HELLFIRE reliability has proven rock solid in both Iraqi wars.

Thus an inert object can passively and surgically slice a shock wave traveling at about three miles per second into discrete segments with significantly different arrival times.

Figure 3:
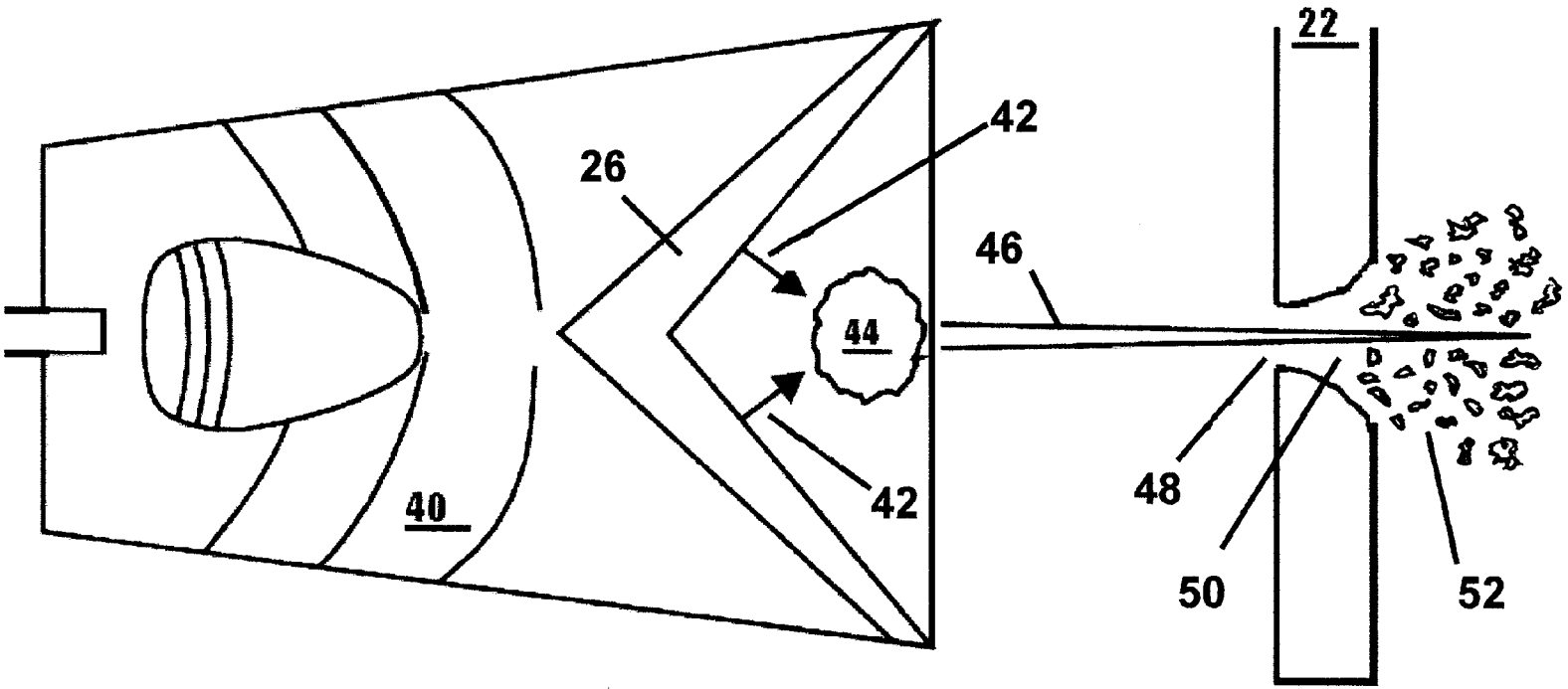
FIG. 3 (Prior Art)
FIG. 3 depicts how the copper stream is formed and smashes its way through the target armor, creating spall as an intended effect.

The second warhead phenomenon of interest has to do with the conversion of shock energy into kinetic and thermal energy within the target, the formation of spall. FIG. 3 depicts this. When the blast of the main charge detonation strikes 40 the copper liner 26 the liner is melted and thrown from the interior sides of the trumpet into the cavity 42. Here the liner ejecta forms a roiling copper soup called the slag 44, but almost instantly the pressures on this liquid mass cause it to eject a tightly focused stream of molten copper 46 at the target 22. The stream is approximately 6 cm (¼ inch) in diameter, 538 degrees Centigrade (1,000 degrees Fahrenheit), and traveling at about 25 times the speed of sound. When the copper stream strikes the armor of the target the over-pressure at the point of impact 48 is in the millions of pounds per square inch. This creates severe hydrodynamic erosion, cutting through the tank armor like a fire hose through a paper towel and creating an enormous shock wave. Shock transmits happily within solid armor, but as it approaches the back side of the armor there is nothing to contain the energy. Accordingly the shock wave tears out chunks of the back side of the armor wall, forming the somewhat conical spall crater 50 and flinging the metal fragments 52 throughout the interior of the armored vehicle. The debris thus excavated and scattered is called spall. In transporting and transferring the considerable energy of the shock wave to the people and objects throughout the interior of the vehicle, spall formation is the secondary kill mechanism of the warhead.

A mechanism for surgically dissecting a 4.8+ km per second (3+ mile per second) shock wave has been proven using a wave shaper, and as a mechanism for dissipating an impinging shock wave has been proven in the creation and propulsion of spall.

Figure 4:
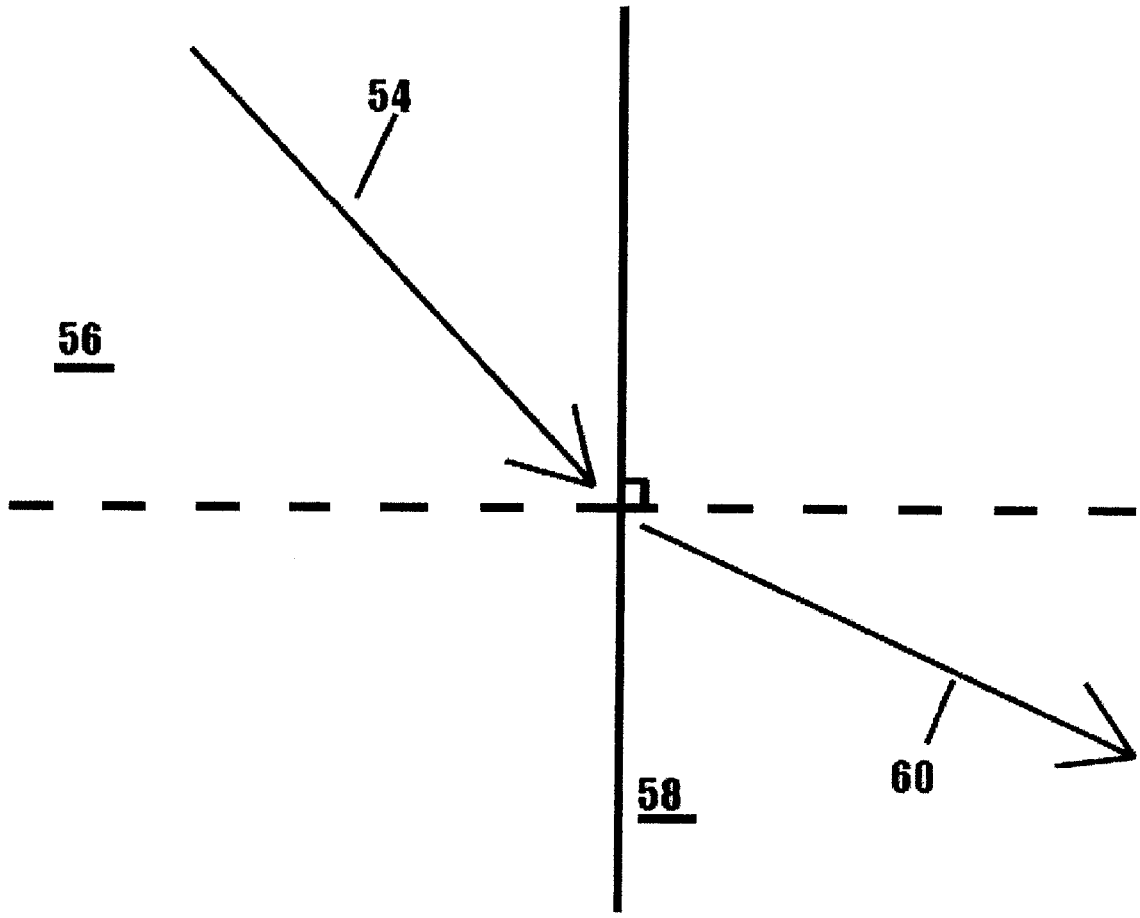
FIG. 4 (Prior Art)
FIG. 4 illustrates the refraction of a wave at an interface.

The next mechanism to be considered is refraction. Refraction is the bending of the axis of travel of a wave as it passes from one material into another where the two materials offer different speeds for the wave relative to each other. FIG. 4 illustrates. In the figure the wave vector 54 travels through a material 56 until it impacts an interface with a less rigid material 58. The wave crosses the interface with a new vector 60 due to refraction at the interface. The formula for the phenomenon is given by Snell's equation:

$$\frac{\mathrm{Sin}\theta_1}{\mathrm{Sin}\theta_2} = \frac{V_1}{V_2}$$

Where $\theta_1$ is the angle of incidence; $\theta_2$ is angle of refraction; $V_1$ is the speed of light in the first medium; and $V_2$ is the speed of light in the second medium.

Figure 5:
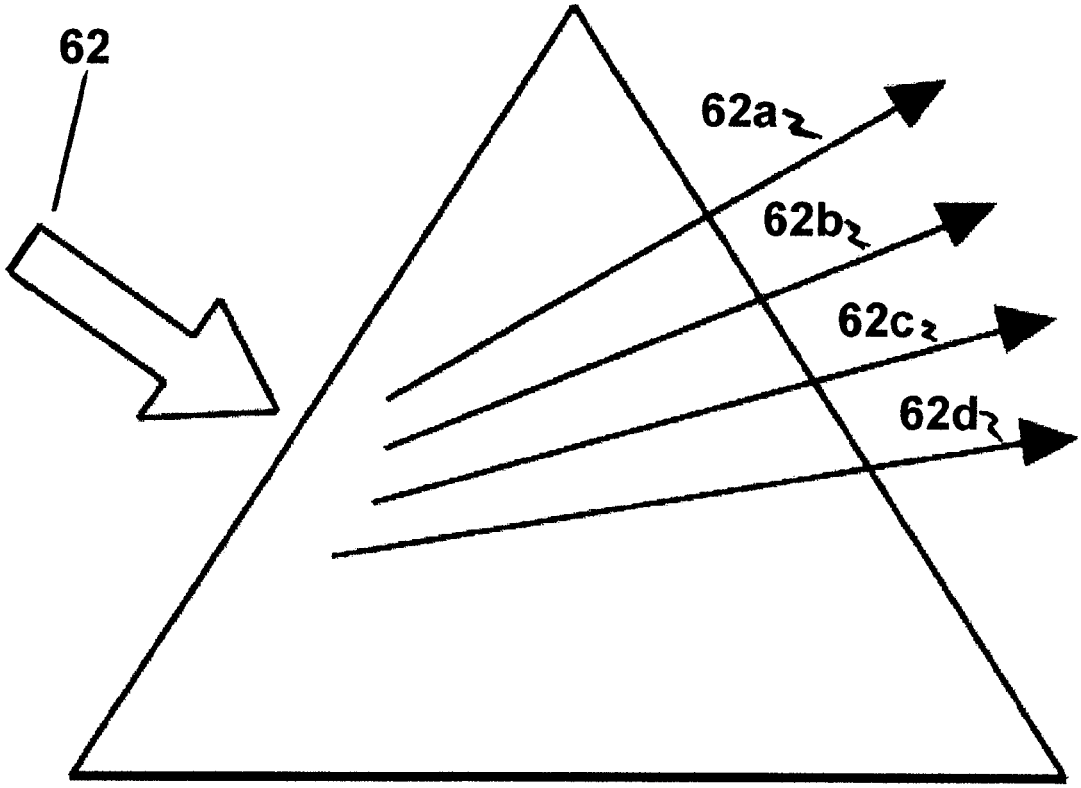
FIG. 5 (Prior Art)
FIG. 5 illustrates the refraction of light into its component wavelengths.

If the wave speed in the second material is slower than that in the first, the wave will turn into the second material. On the other hand, if the speed in the second material is higher, then the wave will turn away from the interior of the material and back toward the interface. FIG. 5 illustrates the first pattern in a prism, where an incident wave 62 is refracted into component frequencies, rays 62*a* through 62*d*.

Figure 6:
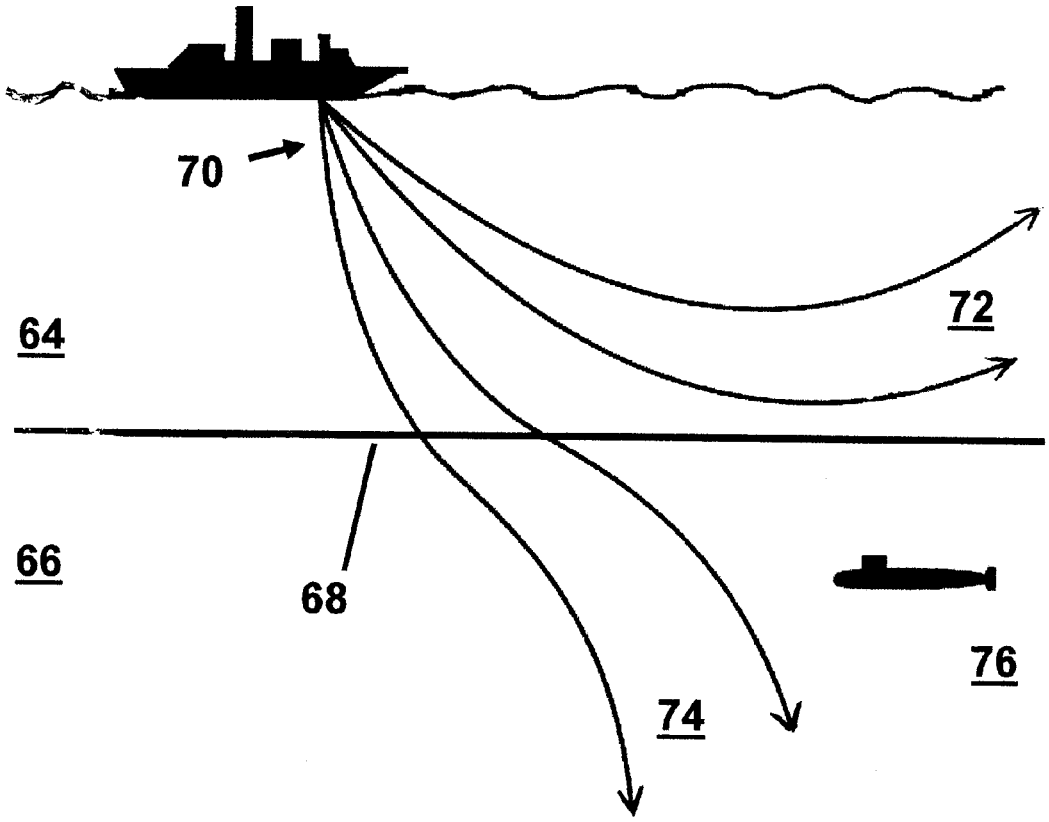
FIG. 6 (Prior Art)
FIG. 6 illustrates the splitting of sonar waves and the subsequent refraction of the components into two different directions.

FIG. 6, extracted from a US Navy illustration, depicts the phenomenon of wave separation followed by simultaneous refraction in opposite directions, which creates the sonar shadows. In the figure the upper water layer 64 is warmer and less dense than the lower layer 66. They are separated by the thermocline 68. In this Navy-created scenario the speed of sound is not constant even within the separate bodies of water. It increases steadily from the surface down to the thermocline and then decreases steadily from there into the depths. Sonar waves from the ship on the surface 70 are split and refracted in opposite directions as they encounter the two layers of water with different sound speed characteristics. The sonar rays separate into two components which each wheel toward the directions of the slower sound velocity ahead of them. Thus the original single wave is transformed into two different waves pursuing increasingly divergent paths. The waves projected toward the interface between the two layers at relatively oblique angles are reflected away from the thermocline and then refracted toward the surface 72. The rays at steeper angles with respect to the interface cross the interface and are then refracted in an increasingly vertical pattern into the deeper water 74. Just beyond where the two diverge is the shadow zone where submarines 76 like to hide because there they are passively hidden by the physics of the sea. The same effect is used routinely in mapping the geologic structures using seismology.

Figure 7:
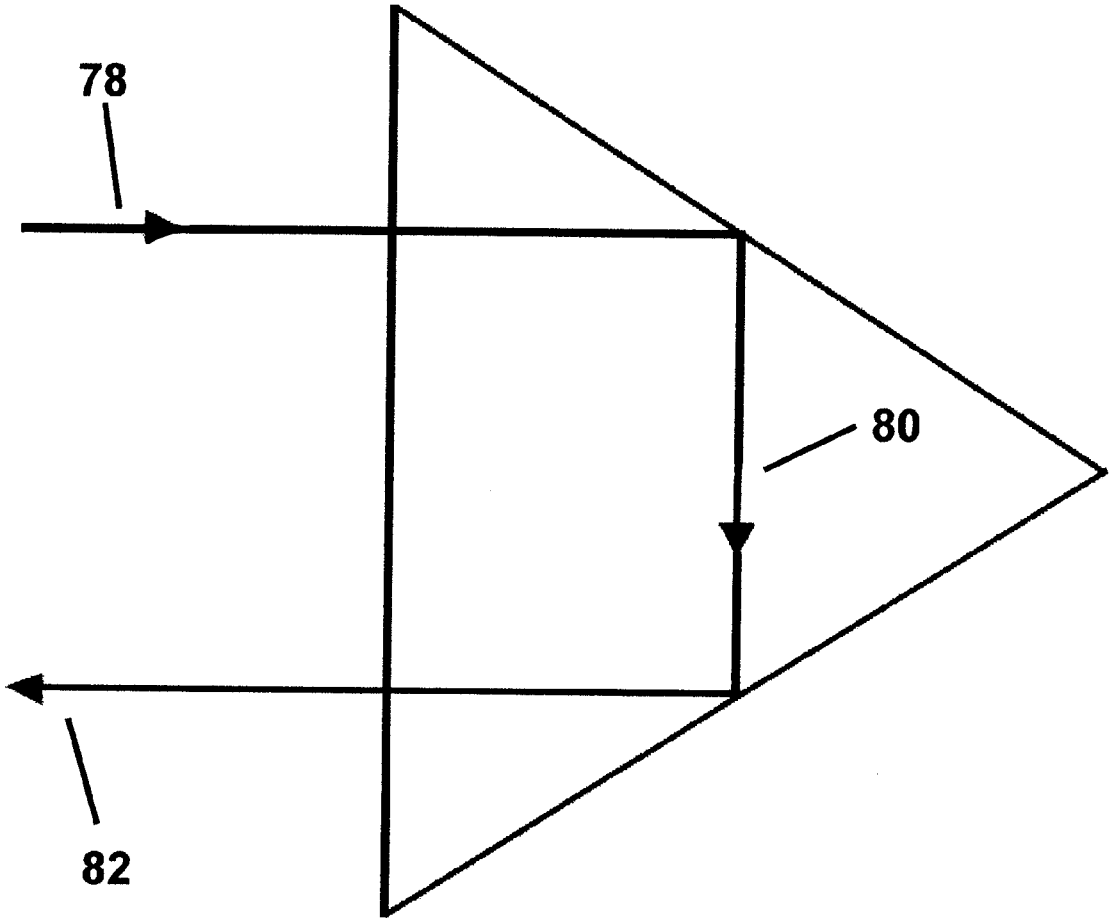
FIG. 7 (Prior Art)
FIG. 7 illustrates total internal reflection.

A special condition exists when a wave moves from a high speed medium into a slower one. A ratio of the speeds and a critical angle of incidence exist where the wave will not cross the interface but rather will be reflected. The critical angle is also called the angle of total internal reflection. FIG. 7 illustrates how a prism can be used as a reflector by exploiting the angle of total internal reflection. The incident ray 78 is reflected to a new vector 80. The new vector impacts another interface, and it is also reflected 82. With reference to FIG. 4 the critical angle can be calculated using the following formula:

$$\theta_{critical} = \mathrm{Sin}^{-1}\left(\frac{V_1}{V_2}\right)$$

By adjusting either the incident angle or the ratio of the speeds the reflected wave can be driven off the interface and away from the second medium.

An every day example of the use of total internal reflection comes from the technology of fiber optics cables. A fiber optics telecommunications cable has a core of fiber glass that carries the input light from origin to destination. It is surrounded by a layer of cladding. The cladding is composed of a material that does not allow the light that strikes the outer walls of the core to pass into the cladding. Instead the light bounces off the cladding and back into the core. This is not done with a mirrored finish; it is done by the technique of total internal reflection. Given the extraordinary durability, efficiency, and growing popularity of fiber optics communications networks, it is clear that total internal reflection is a well established optical engineering feature.

Therefore, it is clear that waves can be refracted or reflected by properly locating astride their path or at an appropriate angle a boundary which separates materials with different wave speed characteristics. This includes both longitudinal waves such as sound and translational waves such as light. Earthquake waves present in both these forms.

Figure 8:
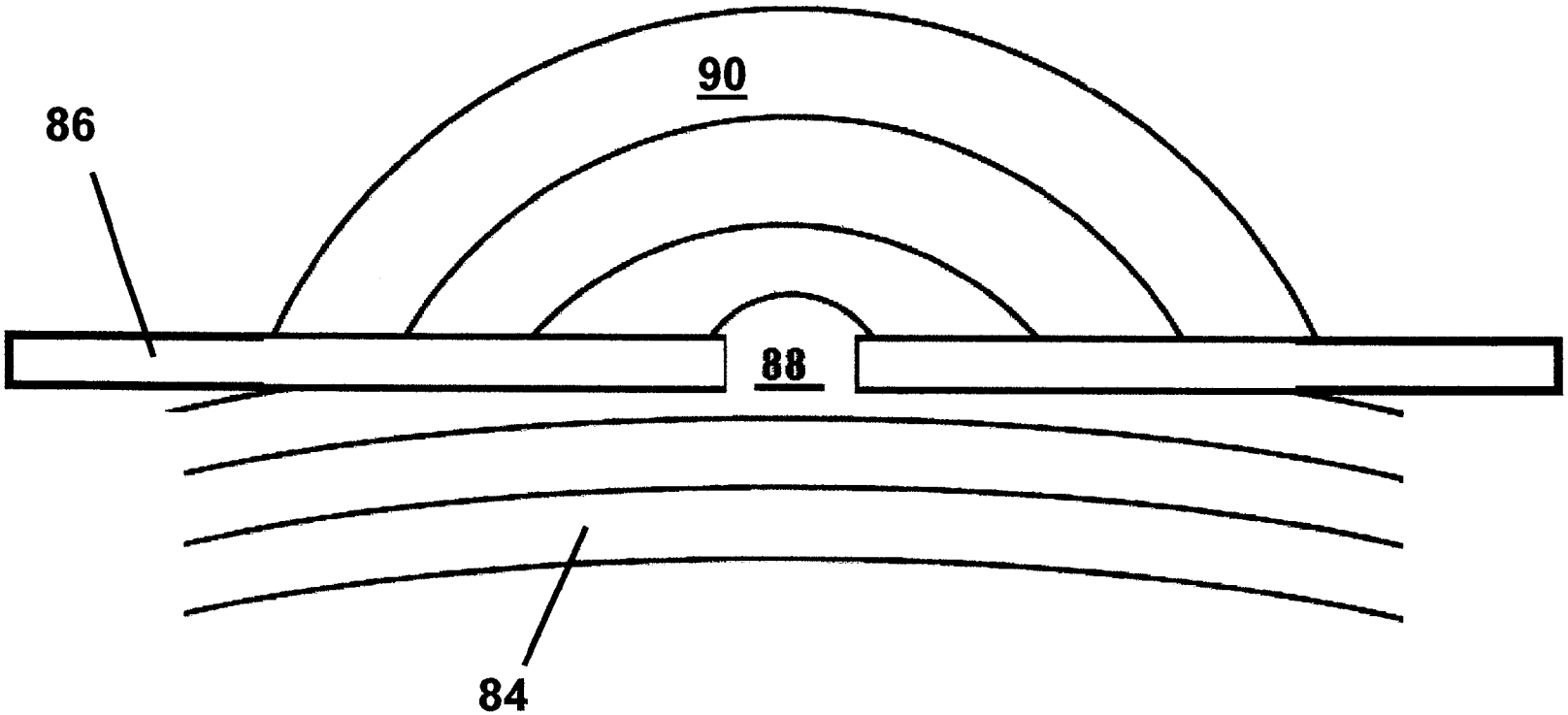
FIG. 8 (Prior Art)
FIG. 8 illustrates wave diffraction at an iris.

The last mechanism to observe is the diffraction grating. FIG. 8 illustrates this. The incident wave 84 is blocked by the rigid plate 86 except for a small portion that passes through the iris 88. The portion of the wave passing through the iris will tend to naturally spread itself as it passes through the opening, changing from an emerging point source with one energy density across its front into a hemispherical wave front with considerably lower energy density 90.

System Design

The overall design strategy of the present invention is to reduce the inbound earthquake waves to manageable levels and then, exercising multiple active systems, to mitigate the effects of the remaining shock. Specific methods to reduce the magnitude include the sum of multiple mechanisms: channeling some of it away from the protected area by the use of refraction and reflection; absorbing some of it within the geologic structure by means of passive and active devices; chopping it into separately arriving packets by causing speed changes within the waves themselves; and spreading the shock waves by emplacing the different devices as an integrated diffraction grating. The invention consists of a plurality of passive and active devices designed for and integrated into the geologic structures at all depths plus the command and control system that collects data; evaluates the evolving situation; determines that an earthquake may be happening or has occurred; selects and activates the active countermeasures, networks, and alarms that will for that situation best protect the area being defended; iteratively executes the measure-predict-calculate-activate defenses cycle; deals effectively with multiple near-simultaneous earthquakes on a systems basis; and reconstitutes the defensive posture on a dynamic basis autonomously. Characteristics of these devices are as follows, given that the dimensions of the devices may be huge or very small, reflecting geological conditions, including the most likely axes of advance for each site from the faults considered most dangerous. Specification of the requirements for any particular site, however, will allow the device dimensions to be fully determined during the development stage.

1. Wave Shapers. Wave shapers are in-ground objects designed to change the propagation characteristics of the shock wave vector but not necessarily reduce the total energy. They may be as large as miles across or in height, or they may be inches on a side. Size determinants will include the type of material and the size of the geological channel in which each is sited, the size characteristics of the wave to be anticipated within that channel, the mission intended, and the capabilities for the necessary mining and installation available at the time of their construction. They may or may not be homogeneous, and their density may or may not be uniform throughout.

Figure 9:
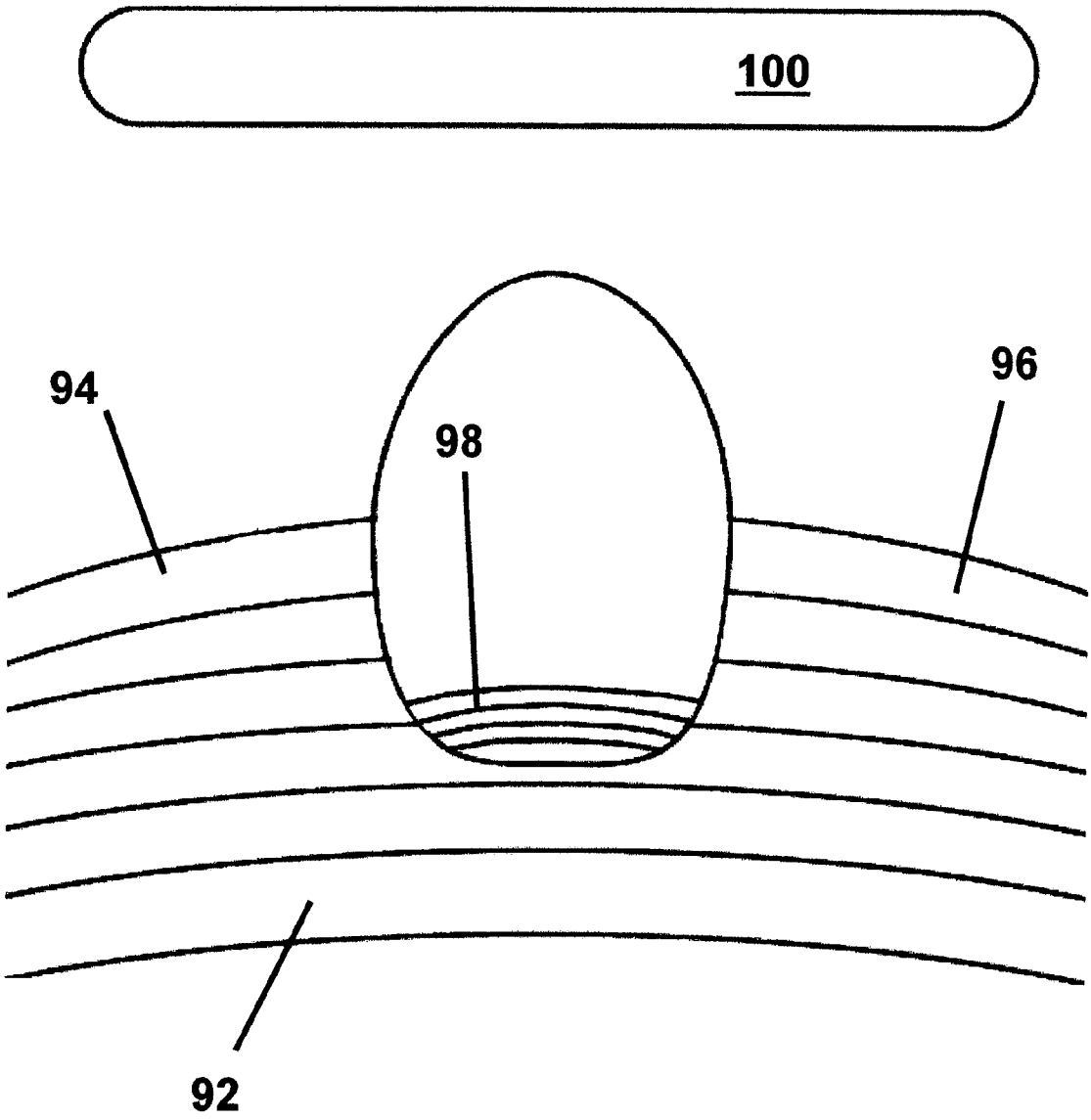
FIG. 9 illustrates a wave slicer.

One basic design is a wave slicer. FIG. 9 illustrates using a top-down perspective. This object works like the wave shaper in a shaped charge warhead. The wave shaper slows the center of the approaching wave 92 so much that it effectively creates three waves, two of which are on the outside and will arrive together 94 and 96, and the third in the middle 98 which will follow them. Thus it creates a condition of temporal separation, potentially significantly reducing the energy transfer into the protected objects. The longer the dimension of the device along the earthquake axis and the greater is the wave speed differential between it and the channel in which it sits, the greater will be the temporal separation. Done carefully, this can greatly reduce the acceleration—duration area, and thus the damage potential. To the extent this device diffracts the first arriving pair toward the center and each other it will reduce their peaks without stretching out their integration time on the structures in the defended area 100. If the two lateral components do not fully come together, an effective zero acceleration node will accompany them, thus effectively causing two zero crossings at the time of impact, one for each of the two slices at the points where the middle slice has been held back.

Figure 10:
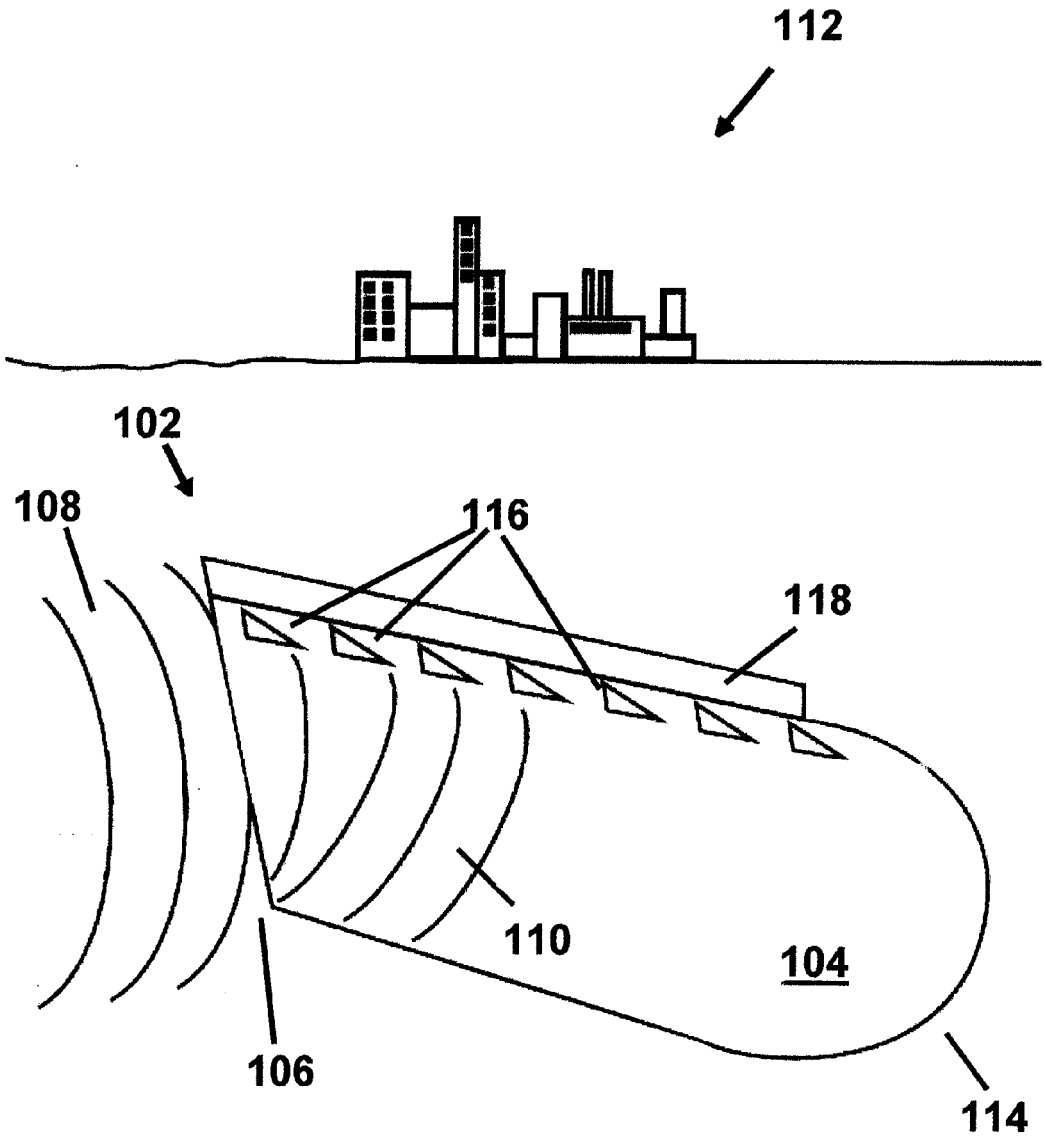
FIG. 10 depicts a refractor with imbedded reflectors.

The second form is a refractor or channel. FIG. 10 illustrates using a side view. A vessel 102 is filled with material 104 considerably less rigid but denser than the geological channel at the approach end of the object 106. To the greatest extent possible the filler is not uniform but rather has a shock velocity gradient that is optimized for refraction. This wave shaper passively refracts the incoming wave 108 into a safe direction 110 away from the defended area 112. The new direction may be a bypass into a natural channel leading away from the defended area; or it may be toward an array of dissipation chambers; or it may be to a disperser 114. A disperser is a shape on the exit end of the vessel that encourages departing waves to refract outward over a quadrant larger than a more rectangular termination would be expected to induce. The edge of the vessel toward the defended area may have an armored spine: it could be lined with shock reflectors 116. These are devices whose shape, materials, and siting combine to foster internal reflection. The vessel may be backed with a cap of non-transmissive material 118 to absorb shocks generally and to function seismically as a giant neutral density filter would in optics.

The technical approach where the material in the vessel has a much lower shock wave velocity may offer the advantage of reusing at least some of the debris excavated during the installation, which might be mixed with additional materials rather than fully excavated. A channel of the opposite effect, one that provides a higher speed to the shock waves, would probably be much more expensive to build.

Figure 11:
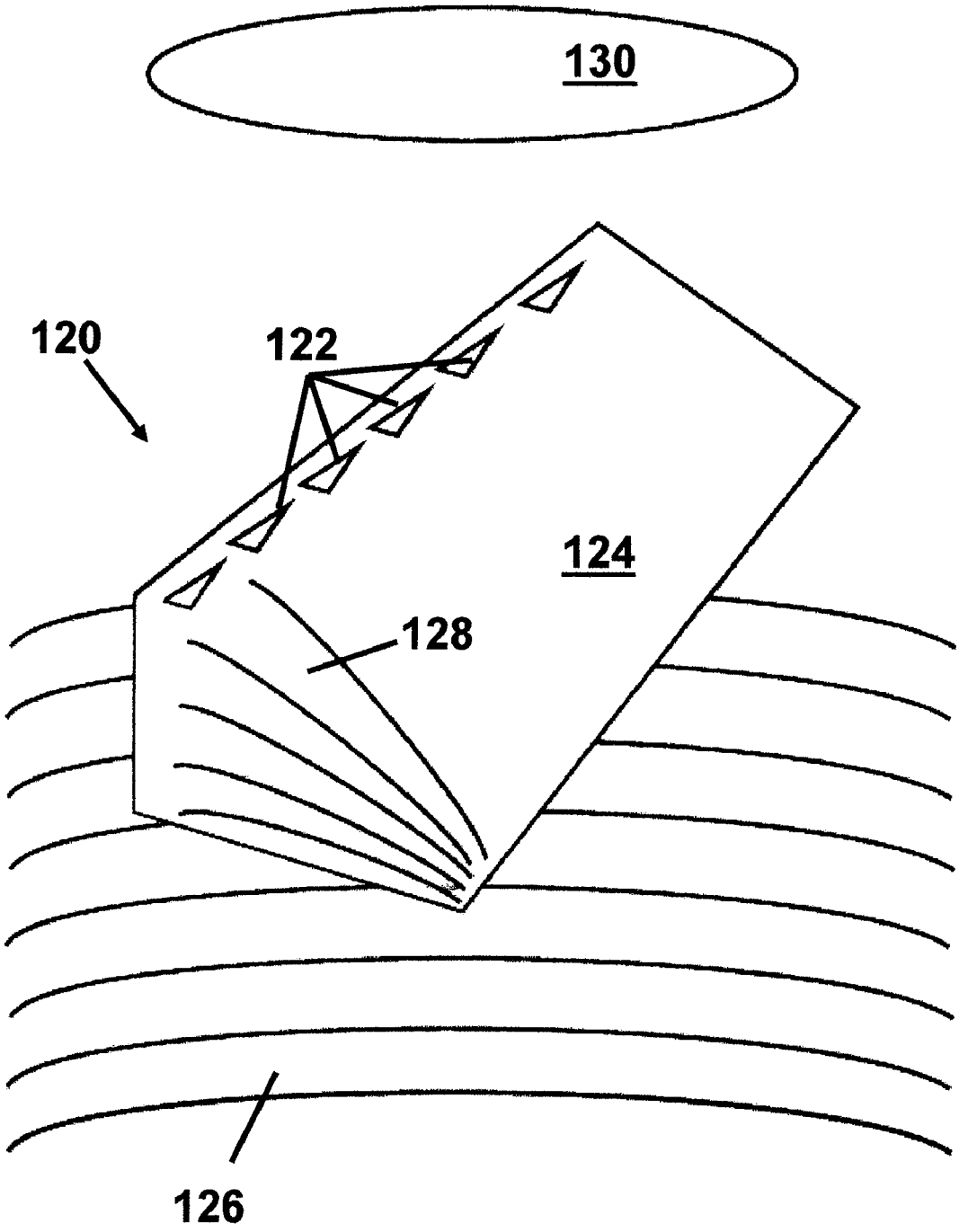
FIG. 11 illustrates a horizontally acting refractor.

FIG. 11 illustrates a refractor sited to channel shock away from the defended area in a horizontal plane. The vessel 120, reflectors 122, and inner fill 124 will refract the incident shock wave 126 away 128 from the defended area 130. A non-transmissive backplate is an option not pictured.

It may be that these deep structures could provide a use for certain materials currently considered environmental hazards. One material that might prove excellent for the dense construction if it can be securely contained would be depleted uranium. It is extremely dense, relatively workable, and of little other use in normal society. Depleted uranium, however, does have a number of negative aspects, among them that it poses a severe threat to water contamination. Additionally its use could potentially be politically unacceptable.

Advanced versions of wave shapers might utilize electronic controls for optimized self-reconfiguration. Various servo-operated valves, barriers, and other devices might be utilized to tune response, but this is highly speculative given the depth and expense of such construction and, more importantly, the overarching need for maximum durability under extreme conditions.

Where practicable, wave shapers and other devices to be described shortly would be installed in a complex that constitutes a diffraction grid with respect to both the horizontal and vertical planes. If wave shapers are placed in a relatively wide, flat matrix such that the shock energy passing these devices from below is truncated on their sides as it passes, it may essentially represent a wave being passed through a diffraction grate with multiple irises. Similarly if flat matrices are built in layers, a vertical diffraction grid would be created for defense against waves coming in at an angle from the vertical. For a given urban area the overall complex might be a subterranean, inverted, hemispherical shell. The shell would be a number of devices thick, but the actual volume of the devices themselves would be a small fraction of the bounded volume. An analogy might be a triple thick chain link fence installation around a 19,844 square meter (5 acre) storage lot: the volume of the protective structure is vastly less than the volume bounded. The interior of the shell would be the existing geologic structure essentially untouched. The reason for such a shape is that, depending on the location, and pending further studies at any given site, earthquake shock waves include surface and body waves from almost any in-ground and surface direction. Since transmission paths will vary, the potential range in angles of ingress is largely unconstrained. Therefore, except where engineering studies can conclusively define the axes of greatest threat, a hemispherical design must be considered the default approach. As previously noted, the size of each device will depend on where it is, what it is made of, and what it is supposed to do.

Many if not all of the wave shapers will be emplaced so that repairs and replenishment will be extremely difficult or impracticable, particularly if the shafting that have might originally been installed during their construction is damaged by the earthquake.

Therefore durability during extended quiet times and also during execution of the primary mission will be extremely important. Fractures anywhere in the structure may cause major discontinuities in intended paths and thereby significant reductions in effectiveness. They may, however, also create retro-reflections which would help disrupt propagation of the destructive energy. Also the interface between the structure and the surrounding geologic structure must be considered both before and after an event for consideration of changes to the physical interfaces.

2. Dissipation Chambers. Dissipation chambers are in-ground earthquake kill zones. In passive chambers, which are particularly suited to deep installation sites, they promote the conversion of very large proportion of the incident energy into kinetic and thermal energy within the chambers. In active dissipation chambers, which must be more accessible from the surface with respect to replenishment and command and control, they provide a way to strike the earthquake waves with a counter-stroke specifically created to neutralize some of the destructive power. Dissipation chambers could take many shapes, and they could be any size. It is likely they would be very much wider than high, depending on where in the complex they are sited.

Passive dissipation chambers can be used at any depth, but they are uniquely suited to deep emplacements. They have two characteristics. The first is that they would be filled with a medium like gas or water with a low shear wave transmissivity. As is well-known, by this feature those shock components acting horizontally would be eliminated automatically. For eruptions nearly directly below the defended areas this would include major components of both the S-H and S-V waves. The other characteristic is that their lower quadrants would be lined deeply with unattached materials that would absorb the upward, compressive, shock wave and then, like the back, inside wall of a tank struck by a shaped charge warhead, spontaneously accelerate from their place of repose. Thus all forms of the incident shock energy would be at least partially dissipated or blocked.

The use of two non-transmissive media together, such as a layer of water overlaid with a layer of compressed gas, would enhance the effect. Together they would reduce the horizontal shock components. The viscosity of the liquid, however, would also make the artificial ejecta dissipate its energy faster, possibly allowing for lower heights of the chambers.

Figure 12:
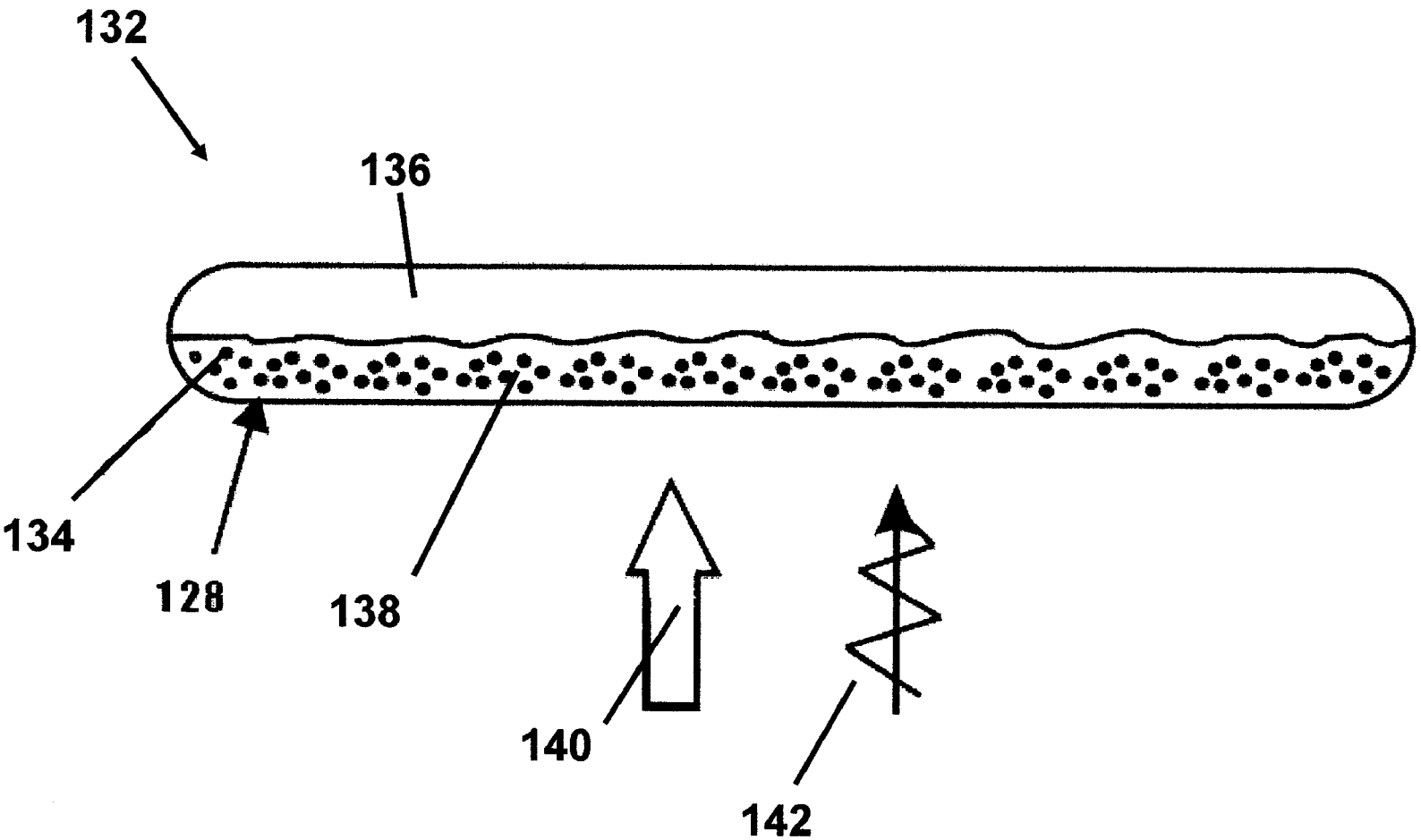
FIG. 12 depicts a passive dissipation chamber.

FIG. 12 illustrates a chamber 132, liquid 134, gas 136, and artificial spall 138 in place and awaiting the arrival of compressive shocks 140 and translational shocks 142. Stainless steel balls are one possibility. One of the reasons for not filling the chambers with liquid would be to ensure the effective creation of the same "nowhere else to go" situation for the compressive shock wave which is the root cause of the exspalliation inside a tank hull. Thus the translational components would be largely dissipated in moving the liquid horizontally, and the compressive components would be dissipated in moving artificial ejecta vertically, dissipating the shock energy as kinetic and thermal energy. If stainless steel balls prove good for this purpose, then it may be possible to shape the bottom of the chambers so that they roll back into their ready positions after their energy has been dissipated. Thus the defense would reconstitute itself In selecting the materials for such a system the prevention of damage to the chamber and, if possible, to the projectile objects, would be a major consideration. As with the wave shapers, the use of a non-transmissive cap should be considered.

A vulnerability that must be guarded against anytime a defense relies on a body of fluid is to make sure it will be there as long as it is needed. Subterranean fissures forming in the bottom of the chamber could drain the liquid, and fissures in the ceiling could vent a gas layer. Loss of the restraining viscosity of the ambient liquid might mean the artificial ejecta might not be stopped before hitting the chamber ceiling. This might result in damage to both objects. Further, depending on the relative sizes involved, a large fissure could drain a substantial portion of the ejecta from the floor of the chamber. One way to control this is to line the chamber with impermeable liner materials that have extraordinary features with respect to stretching.

Another way to avoid the problem, at least for cities on the west Coast, is to supply a virtually endless and automatically activated source of water. For example, a non-freespan chamber kilometers across but only ten meters (32.8 feet) high could be located four kilometers (2.5 miles) below a city. To maintain structural integrity the volume of the vertical supports in the chamber might be much greater than the volume of the open chamber. All the galleries would be connected to each other by floor to ceiling openings which are occasionally restricted by slosh barriers of less than half ceiling height. The complex could be connected by multiple chimneys to the Pacific Ocean. A bubble of compressed gas at the top of the chamber would ensure the chamber does not become fully immersed. As with the floor of a chamber filled with fluid, an overhead vapor barrier with fissure resistance would be required. Instead of steel balls the artificial ejecta would be rock quarried from the floor of the chamber but not removed. Such a structure would form a vast, totally passive, automatic, self-regulating shock absorber insulating the areas above from major components of any incident wave. Pumps could be used to continuously change the water in the chamber, and gravity would cause the Pacific Ocean to refill anything lost in a fissure.

An advance well into the future that will increase the effectiveness of passive dissipation chambers would be to make the artificial ejecta from a material that would be subject to electro-magnetic repulsion and to install an electro-magnetic repulsion grid above the chamber. This would increase the strength of the force gradient against which the ejecta must advance and thus allow for lower ceiling heights without a loss of kinetic dissipation capabilities. Such a system, however, unless very ingeniously protected against the complications of overhead displacements, would be extremely susceptible to power outages and thereby reductions in both effectiveness and durability. The diversion of power from the emergency grids of the defended area may also be prohibitive in some situations.

Figure 13:
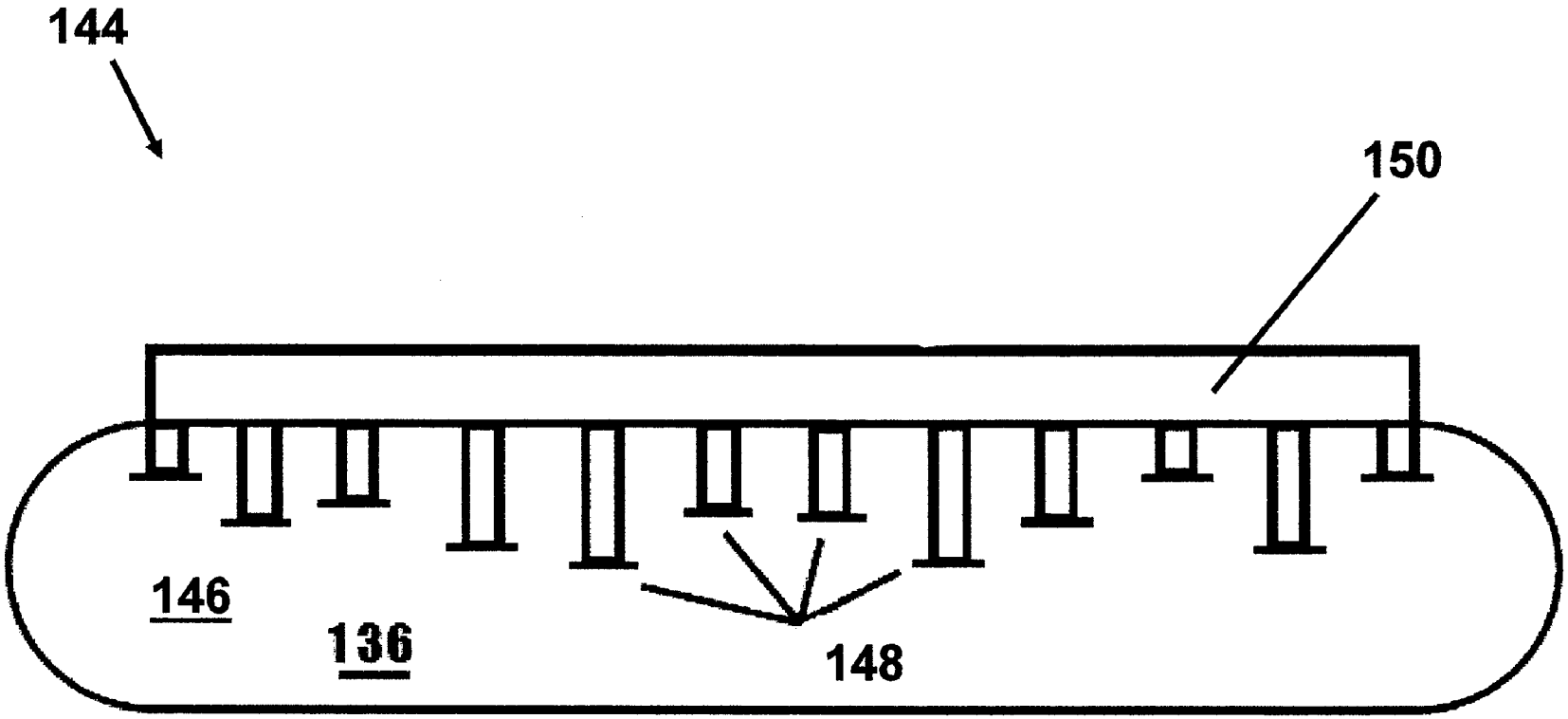
FIG. 13 depicts an active dissipation chamber.

Active dissipation chambers are emplaced relatively close to the surface of the earth. They are completely or nearly filled with fluid into which a counter shock transmitter would be immersed. FIG. 13 illustrates. The purpose is to bring the quake energy into a chamber 144 filled with a material that transmits compressive shock efficiently, in this case a fluid reservoir 146. Then the defense will hit the incoming wave with an oppositely directed blast of energy in wavelengths that will interact with it destructively. In this figure counter shocks are transmitted from the inverted cylindrical objects 148 hanging from the ceiling of the chamber. Given the disparity between the magnitude of even an M4 earthquake shock and a man-made shock, the main purpose of shallow-sited dissipation chambers for the foreseeable future would be to provide additional protection for specific structures or complexes needing it or to break up any detected harmonic accumulation of earthquake waves emerging from the various defenses. An example of the former might be a dam or a nuclear power plant. Depending on the type of counter shock system selected, it may be necessary to install shock insulation on the top of the counter shock generator. One approach would be to top the counter shock generator with a massive non-transmissive layer as previously discussed 150.

A critical issue of any counter shock system is getting more attenuation of the upward bound, natural shock via the active system than by not using an active system at all and just simply relying on the non-transmissive cap to absorb the compression waves. One way to do this is to deploy the individual counter shock generators in arrays with carefully timed sequential firings. It would require very precise use of harmonics into the medium to aggregate the counter shock energy for maximum cancellation of the compressive wave. It would probably require physical and temporal separation of the impulses on the protected side to limit the total upward shock at any moment and point by segmenting it into discrete packets with relatively low peaks and relatively short durations from the counter shock generators.

For example an underground, relatively shallow lake 2,000 meters (1.2 miles) below the skyscraper part of a city and dimensioned such that the whole high rise district is within its lee may achieve extraordinary reductions in the shocks with which the surface defenses have to contend. The chamber need not be a clear span; very thick natural or artificial columns with or without shock control features would allow a fully supported but effectively vast cavern. Shock transmitted through the verticals must be accounted for, but whatever does escape should diffract upon reaching the top of the support, thus reducing its energy density. Between the changes imparted by the fluid component, the counter shock component, the diffraction of the residual transmitted up the vertical supports, and the non-transmissive cap the power of the shock wave should be attenuated enough to provide critical additional margin to specific structures and sites.

Well-understood mechanisms exist to provide counter shock capabilities for the limited purposes noted. Explosives are the most obvious near-term approach. Explosives' efficiencies toward a single quadrant are low, so enormous amounts would be needed. Moreover, a most difficult aspect of the counter shock feature is adjusting the characteristics of the explosive wave in frequency and timing so that it achieves the desired effect and so the use of the active system produces a significantly better net result than would a passive one. Explosives' detonation wave speeds range from 900 meters per second (0.6 miles per second) for ammonium nitrate to approximately 8,750 meters per second (5 miles per second) for RDX. A relatively new type of munition, fuel air explosives (FAE), offers significant potential advantages in shock peaks and compactness. The use of FAE also may provide the capability to "reload" the chamber after an event in a much easier fashion than would be the case if solid explosives and detonator charges were used.

Another potential approach for creating counter shock is sonar. Sonar is well-established, but the current range of frequencies is too high by a factor of 1 00 or more, and the power is too low. The open literature reports work being done with sonars operating from 100 to 1000 hertz and using power ranges of more than 200 dB. That suggests that lower frequency and higher power sonar may be in work under secret conditions. Two major issues arise from sonar: power levels high enough to do any good and the size of the transmitter antennae. Both of these may be amenable to the previously noted option of deployment in arrays. If deployed, such arrays would receive their power from the primary emergency bus controlled by the command and control system.

Still another approach is to consider mechanical vibration generators.

Dissipation chambers with counter shock features offer the most selective of the last minute defenses that can be brought into play, a relatively surgical final cut inflicted on the inbound threat to drop its specific lethality slightly as part of the terminal defense of specific structures.

Like wave shapers, both active and passive dissipation chambers may be extremely difficult to repair or replenish.

Figure 14:
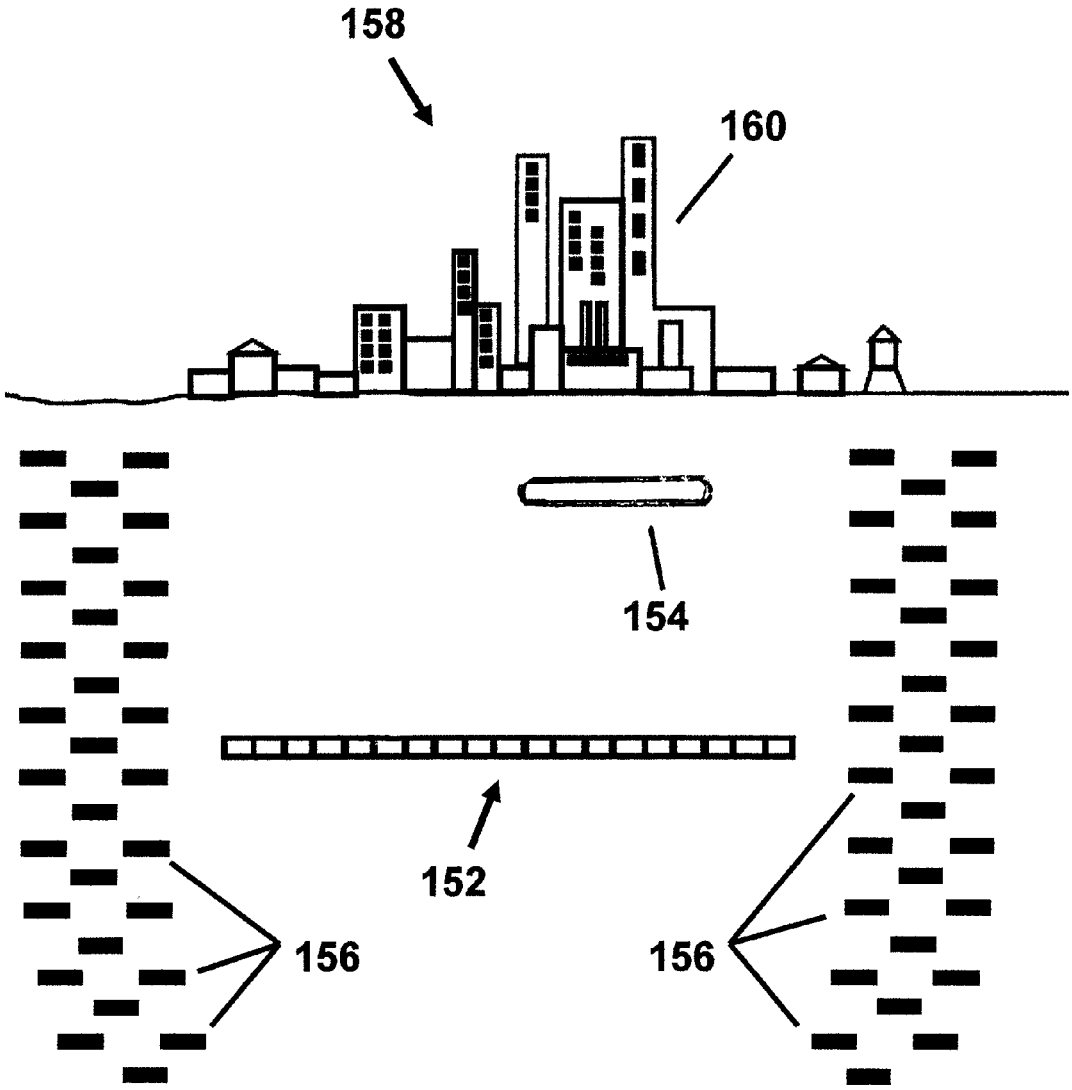
FIG. 14 shows a side view of a nominal, integrated in-ground defense system.

3. The Integrated In-Ground System Structure. FIG. 14 shows one nominal installation. In creating the overall defensive complex a pattern would be to install layers of dissipation chambers 152 and 154 inside the outer shell(s) of the wave shapers 156. In the figure device 152 is a passive dissipation chamber protecting the whole defended area 158. Device 154, on the other hand, is an active dissipation chamber emplaced to provide additional protection only for the sky scraper district 160 within the defended area. The layers would have enough chambers that for a significant depth the structure would like a relatively thin but giant membrane of urethane foam. As noted, the actual volume taken up in the separate devices would be a small fraction of the bounded area. Of course the separation and dimensions of the chambers would be such that the strength and rigidity of the overall geologic structure would be left at an unquestionable level of integrity. Significant, passive attenuation of the shock from all axes could be achieved, greatly enhancing the ability of single site and single structure defenses within the top 100 meters (328 feet) of the surface to cope successfully. The actual structure of the in-ground complex would be designed to optimize shock wave diffraction and overall structural integrity while minimizing excavation requirements.

4. Electro-Magnetically-Based Defenses

Defended structures can be equipped with powerful self-defense capabilities by building into them electro-magnetic (e-m) levitation and motion control systems. The use of electro-magnetic forces for the levitation and propulsion of heavy passenger trains at speeds up to 400 km per hour (250 mph) is well-established. Migration of this technology to structural systems will provide the capability for active, controlled isolation of the structures from the destructive shaking. Such adaptation of the technology to the new use of earthquake defense is low risk as long as limitations of the technology at any given period are respected, and provisions are made for reliable delivery of adequate electrical power. Further, the capabilities and cost effectiveness of this approach can be expected to grow as advances are made in super-cooling and other new technologies.

The magnetic levitation earthquake defense system comprises two basic types of structural couplings, levitation couplings and location couplings, deployed in two types of arrangement. The first is single structure. The second is single site. The latter, a single site, may be multiple structures whose individual systems are linked by a single command and control system or a combined power supply or a combination of the two. This may allow optimal deployment of semi-independent control and power systems that can operate the single site defenses despite break downs in the overall communications and power grids.

Figure 15:
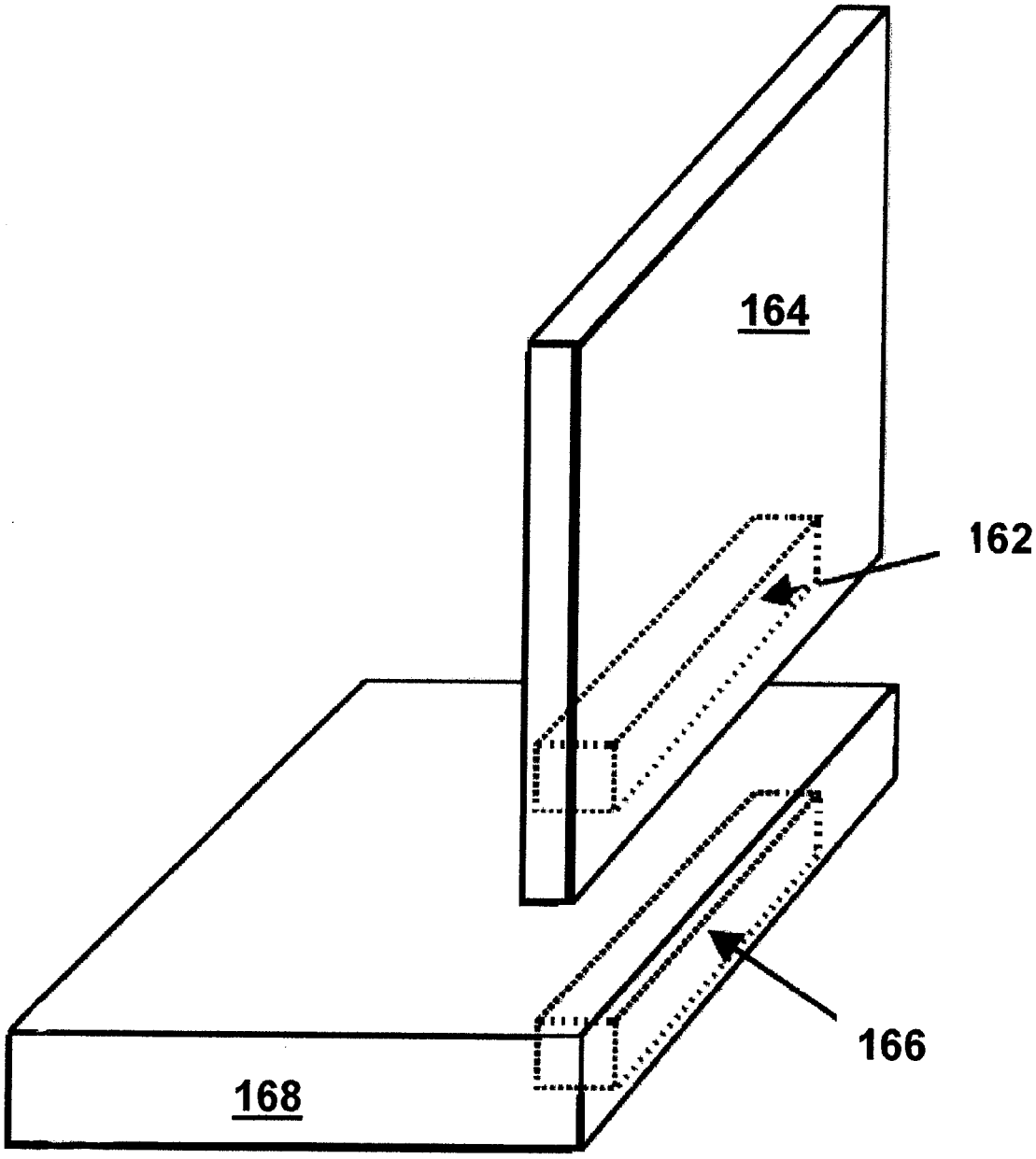
FIG. 15 depicts a levitation coupling.

The first type of coupling is the levitation coupling, which is depicted in FIG. 15. It includes an electro-magnetic coil assembly 162 located in the bottom portion of a wall 164 and another electro-magnetic coil 166 located in the foundation 168 directly below where the wall will sit. The coils are connected to electrical power and to control machinery. The surface between the foundation and the wall may be a low friction surface, such condition created by lubrication, surface material selection, or other approach. The wall is not fastened to the foundation but instead sits atop it. Where necessary, removable pins or other mechanical connectors may be used to provide retention against hurricane or other exceptional forces that might otherwise displace the structure from its foundation. These connectors would be automatically retractable by the earthquake command and control system as a preliminary measure upon threat of an earthquake. Careful design would ensure that shifting of the structures against the connectors would not inadvertently prevent their disengagement during an earthquake emergency. The electrical current input to the two coils will cause the electromagnets to repel each other. The repulsive force may be as little as what constitutes "just enough lift" (JEL), or it may be so much as to cause the wall to rise well clear of the support structure.

"Just enough lift" refers to the condition where the net down force on an object has been lightened to the point where it is still in contact with the surface below, but lateral motion is possible with acceptable dragging between the upper and lower objects. An analogous situation exists in a standard technique utilized by pilots of helicopters equipped with skids for landing gear instead of wheels. Sometimes these pilots need to take off when they do not have enough power to actually fully break contact with the ground, let alone hover. They increase rotor power to the point where they are light on the skids but still in contact with the ground. Then by minute forward control inputs they can very gradually and gently accelerate forward until they have reached translational lift speed, which catapults them up and into flight. During their takeoff run their skids are in contact with the ground, but the down force is sufficiently small that no serious damage is done to the skids. In the present invention the term refers to lifting the wall until its downward force does not create enough friction with the surface below to prevent motion or to cause unacceptable damage to either of the surfaces in contact.

Figure 16:
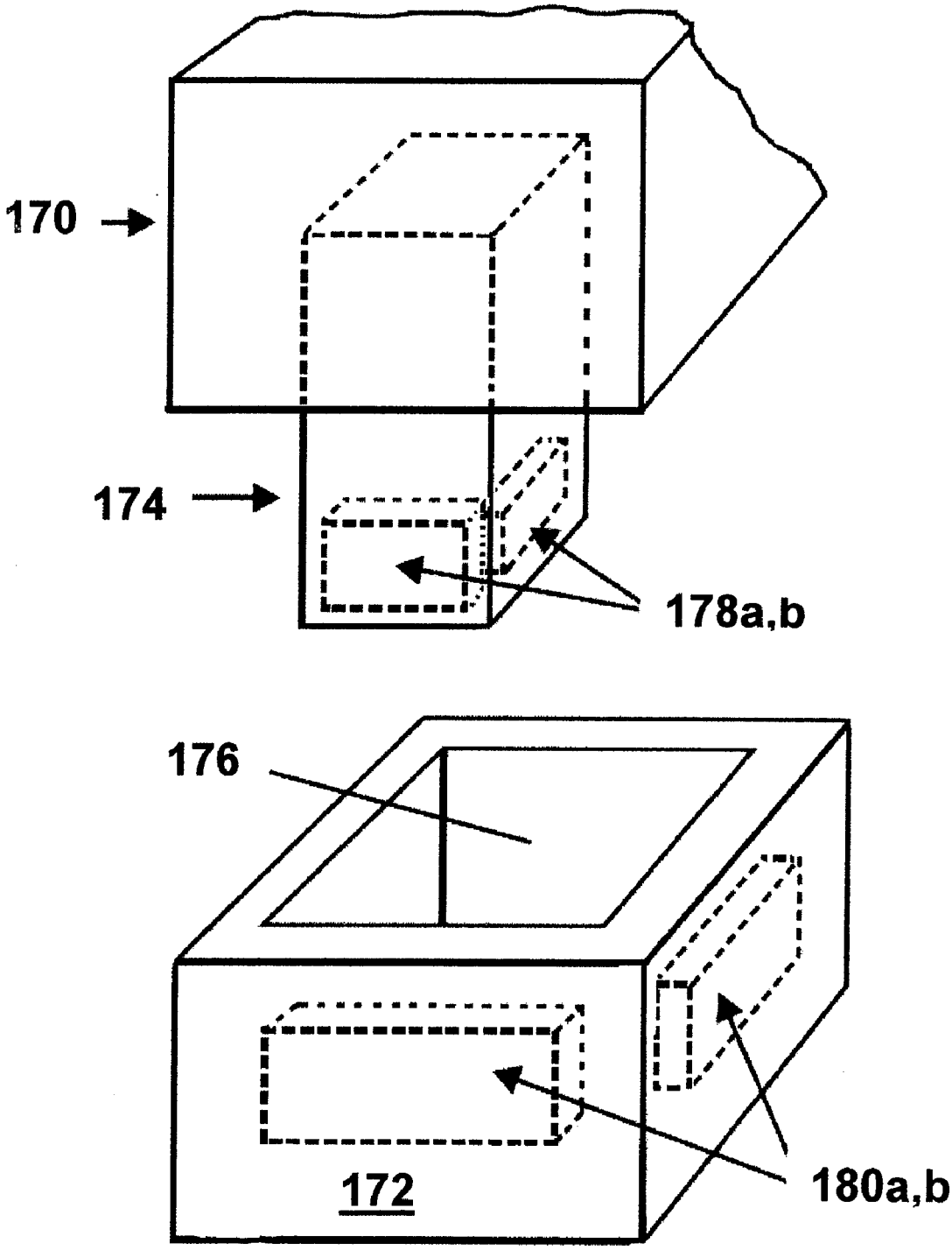
FIG. 16 depicts an electromagnetic structural location coupling.

The second type of device is the location coupler as shown in FIG. 16. The location coupler is made of a male connector 170 and a female connector 172. The location pin 174 on the male connector is smaller than the receptacle 176 on the female connector, with space on all sides. Both the male and female connectors have electro-magnetic horizontal motion control coils 178*a* and 178*b* and 180*a* and 180*b*. These act like the acceleration coils on magnetic levitation trains to move the trains forward. In the case of the present invention they are arrayed to induce or control motion in both horizontal axes and radially.

The building to be defended is constructed with some or all the floors not fly joined to the structure below. The structural joints between the floors at predetermined places contain levitation couplers. These are located not only at the perimeter but wherever rigidity in the lifting structure is required to prevent buckling or other damage. At the corners of each floor and elsewhere as necessary are installed location couplers. To prevent excessive wander of the levitated structure away from the fixed coils in the foundation an array of sensors and a control loop provide a gradient of increasing force against outward travel. Alternatively a physical apparatus such as a spring and shock absorber system could be used. Weather sealing and water sealing at the decoupling joints accommodate the motion without appreciable interference and are readily restorable after the event.

Primary emergency power is connected to the levitation couplers. Power to the location couplers for ground level structures may be applied by a secondary emergency bus that will be disconnected if there is not enough to energize the primary bus fully. Where the decoupled structure is an upstairs portion of a building, however, power to the location couplers must come from the primary bus. Standby power supplies are located on site or nearby. The defense system is controlled by a computer either in the building or in a remote site, or in both places in a primary and backup arrangement. The control computer(s) are compatible with the external emergency information and command and control systems. Plumbing and other utilities are installed so that they can accommodate motion of the structure. In some buildings the present invention may be of greatest use on some of the upper floors rather than for the whole structure.

Alternatively, levitation couplers and location couplers can be interspersed along the bottoms of the walls and in the corners, or motion control couplers can do additional duties as levitation couplers.

5. Automated Command and Control System. The Automated Command and Control System is a system designed to act within the timelines of the earthquake. For the most powerful of earthquakes this may encompass considerably less than a minute from rupture at the causative fault to impact at the point of defense. The system consists of redundant computers, sensors, communications busses, and networks that autonomously or semi-autonomously monitor the local situation, collect and evaluate data, execute decision loops, and integrate with the human portion of the disaster control systems. It is beyond the control and warning systems disclosed by Drake et al, Flanagan, Skoff, Miyahara et al, and Sizemore, adding new capabilities and roles not previously envisioned. Specific capabilities are as follows:

a. The Automated System collects data and alerts from sensors and from the Human Command and Control System.

b. The Automated System analyses the data to determine the probability that an earthquake has occurred.

c. Based upon multiple iterations of the four step response cycle (measure-predict-calculate-activate defenses), the Automated System reconfigures sensors; initiates preliminary alerts and warnings; arms arming-required systems; declares an earthquake emergency; ceases transport of or re-routes liquid flammables and activates control systems to accomplish the same; predicts propagation characteristics of the earthquake when such has been declared; monitors path and intensity of the shock wave through the defenses; issues orders to the reconfigurable elements of the defense, including, as necessary, "commence self-controlled operations" instructions to remote, subordinate command and control systems; and passes information such as the following to the Human Command and Control System:

(1) Origin and characteristics of the earthquake (2) Predicted impact with continuous updates (3) Functional status and need for repair and/or replenishment of all devices in the defense system.

The system deals with multiple near-simultaneous earthquakes on a systems response basis for overall optimized defense.

A critical task for the present invention is the arming of two- or multi-staged responses beyond what has been envisioned in the prior art. For example, if electro-magnetic levitation becomes a significant approach for surface structure defense, it may be necessary to charge local energy storage devices and/or to shunt extra power to areas where such are deployed prior to activating the levitation devices themselves. This latter task itself may require automated diversion of power in the municipal grids in a shorter cycle time than within the human response system. Such, however, could easily be implemented as an outcome of the determination that an earthquake has occurred and, as provided by Flanagan, where it is most likely to hit. Another example comes from the generation of fire fighting materials on-site before the occurrence of the event. In U.S. Pat. No. 6,560,991 (2003) Kotliar discloses how a hyperbaric hypoxic environment can be created wherein an elevated atmospheric pressure allows humans to successfully breathe a gas mixture so oxygen-deficient that it will extinguish fires. This technology allows for all sorts of defensive options, but to implement them may require time to start the gas generators and build up enough supply to cover all contingencies. Activating these devices at the first confirmation of a quake would be a perfect mission for the command and control system. This in turn would even allow prophylactic deployment of such gasses where the structure to be protected is large compared to the generator and deployment apparatus.

A unique and powerful new capability for the command and control system is to actively run the defenses against the earthquake itself. The most near-term capability to demonstrate this advance would be a system comprising the command and control system operating localized electromagnetic single structure and single site systems via communications busses. At the outset of an earthquake the command and control system would make determinations, issue warnings, and commence remote controlling of defensive systems. It would not only shut off flammables pipelines but also arm arming-required circuits, re-route electricity to start boost-charging local stores for the electro-magnetic systems to use, and activate other defenses such as Kotliar's hyperbaric hypoxic fire safety system. On a broader basis the command and control system could automatically activate or withhold activation of the active features of the wave shapers and dissipation chambers or change their characteristics to optimize the overall system response. This would function at all times and always respond inside the time lines for human situational awareness and management. Such a high speed, fully-empowered response system is largely unprecedented in current practice except in the highly accelerated world of military terminal defense systems, such as the defenses against anti-ship missiles. Defending a ship against missiles involves being able to detect, track, and destroy objects as small as approximately a foot in diameter flying just above the surface of the water, traveling at 800 km per hour (500 miles per hour) or faster, and possibly executing evasive maneuvers. When enabled, shipboard terminal defense systems offer at least one fully automated mode because sometimes there is no time for anything less.

The same automated, closed loop requirement exists for some aspects of earthquake defense.

OPERATION OF THE PREFERRED EMBODIMENT

It is not necessary to employ all the elements of the present invention to gain significant advantages. The electro-magnetic single structure and single site defenses and the Command and Control system could be deployed in the near-term at modest cost and immediately provide major advances on the present conditions. The other devices could follow as appropriate, based on systems studies of the human and natural factors and options. The underlying objective of the present invention other than for the single site and single structure subsystems is to reduce the magnitude of earthquake shock in the defended area to Richter scale M4 or less. That may not require the use of all options in every situation.

Planning and Installation

As in few other systems the successful operation of the automated area earthquake defense system will require superb planning and execution. Accordingly an outline of such pre-operational work is hereinafter provided to illustrate the intricacy and magnitude of the planning and installation tasks. Without such work nothing can be predicted reliably.

1. A detailed study is conducted by or for an appropriate agency to determine the following.
   a. Single point sites needing the most protection by reduction of the earthquake effects before it strikes them. This may be focused on structures that are the most difficult to protect using the single point and single site protective measures enumerated above. Such objects may include the following:
      (1) Tall buildings
      (2) Bridges
      (3) Dams and water control facilities
      (4) Nuclear power plants
      (5) Significant facilities for the storage or distribution of flammable, explosive, or toxic materials such as fuels, explosives, fertilizers, ammunition, and pesticides, herbicides, and other poisons.
   b. As exactly as possible the geological structure of the area to be protected and the contiguous areas, especially with regard to faults and shock channels. This would extend as far out as necessary to understand the geologic system of which the protected area is a part and to protect the objective area without creating or aggravating dangerous conditions for a neighboring area.
   c. The state of the art in all applicable disciplines including but limited to earthquake and shock wave sensors; earthquake-resistant, deeply buried communications systems; deep tunneling especially with regard to the use of very wide chambers and underground construction; electromagnetism and electro-magnetic levitation and propulsion; super-conductivity; friction reduction technology; and automated control systems. The current maximum depths for deep tunneling, about 10 kilometers (6.2 miles) due to the extreme pressure and heat, would allow the emplacement of a number of deep devices. Therefore that would not in itself bar a start to such a project, and the practicable depths can be expected to be increased with time.

2. The area to be defended and contiguous areas are modeled and extensive simulation is used to characterize the area with respect to earthquake occurrences and propagation.

3. Potential configurations of wave shapers, dissipation chambers, and single site complexes are designed, built, and extensively used in simulations that characterize multiple areas. It is desired to characterize their performance both as separate devices and as elements of the plurality. Determining how each acts in different geological arrangements is a critical task because some may prove more useful in some areas and less so in others. A critical fact of geometry that must be recognized involves the relationship of the depth of a device to the size of the area protected. The closer to the shock source the protective device is, the proportionately larger is the area inscribed on the surface by its lee. At the same time, the deeper an object is buried, the more likely it will not be in a good position to help with waves coming in from another area. As previously noted in that regard, a complex with a hemispherical outer surface may be required, depending on the geology.

4. For a given area a preliminary master plan is developed incorporating the results of the studies and trials. A preliminary positioning plan for buried devices is completed and preliminary designs laid out for the specific devices themselves. Repair and replacement strategies are also devised. The defended area earthquake simulations are resumed, and their results are fed at the appropriate rate into the engineering configuration control system for the system overall.

5. When the configuration of the plurality has been completed the command and control system and the single site complexes are then configured in the simulation and exercised. In these simulations the effects of triggering multi-step, arming-required processes and equipment, including charging local and backup power for the single site systems; sending alarms; closing valves and re-routing flammables; controlling the reconfigurable elements of the plurality, including levitating and driving structures at the single sites; and reconstituting the whole system after the event ends are evaluated in terms of lives saved and in the degree to which protection systems are able to be reconstituted. The final step will be to finalize the network of replenishment tunnels, networks, and other support infrastructure.

7. Formal development of the system will follow proven program management techniques well established in the large structures contracting and aerospace industries.

Operation

Figure 17:
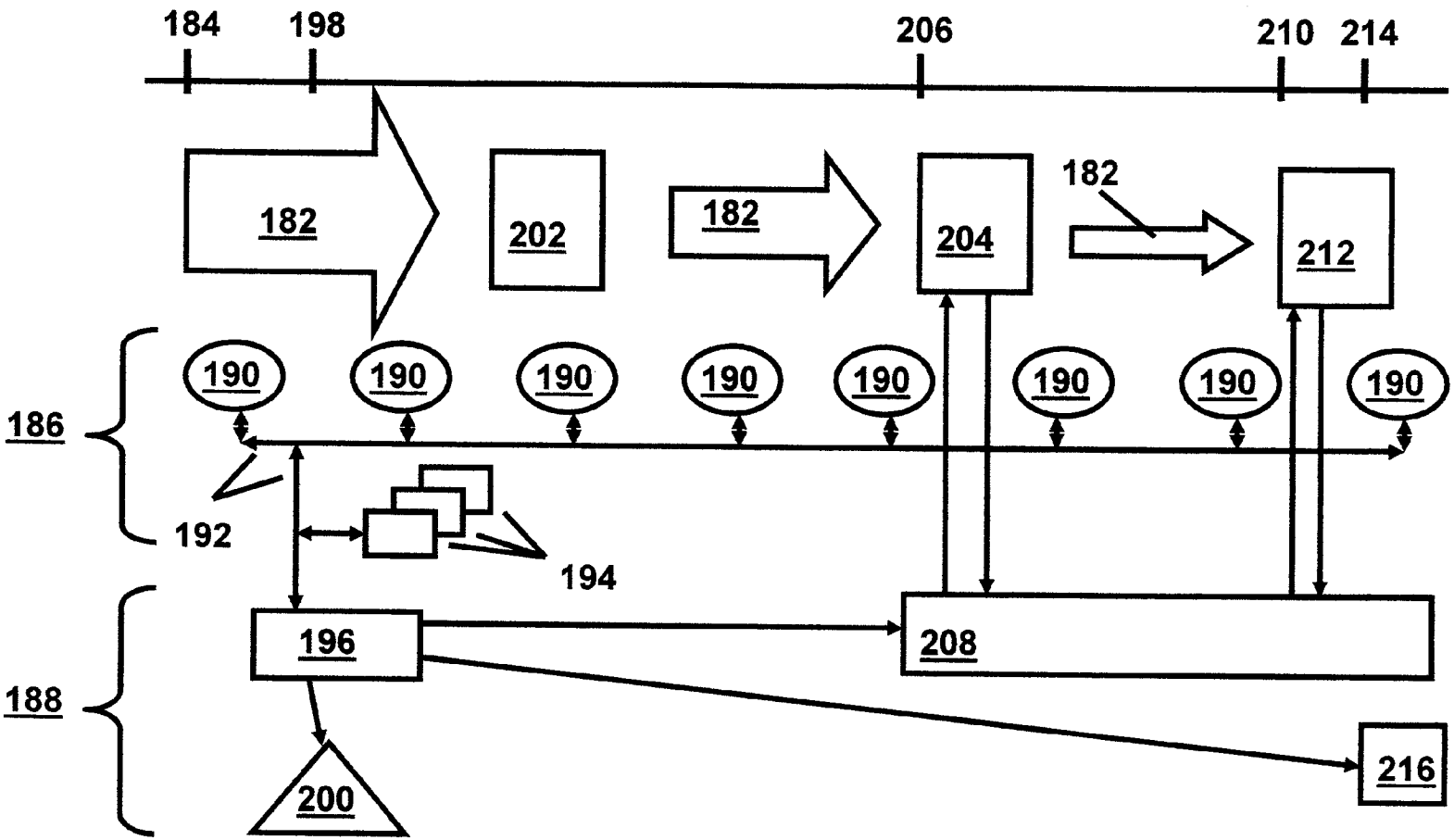
FIG. 17 provides a nominal timeline from the occurrence of the earthquake until after its remnants have impacted the defended area.

The operation of the system is shown in FIG. 17 by a nominal timeline. It is important to remember that from the start to the finish of the timeline may be less than one minute for cities sitting atop major faults.

The event starts with an earthquake 182 at time $t_0$ 184. The overall command and control system comprises the deployed system 186 and the main command and control center 188. The earthquake is quickly detected by multiple sensors which send reports 190 on a communications bus 192 connecting them and the main command and control center and the local command and control systems 194. The sensors will continue reporting throughout the event, and those configured for remote programming will respond as directed. In the main center the data goes to the Automated Command and Control System 196, which commences the iterative cycle. At time $t_1$ 198, upon developing a high level of confidence that a significant earthquake has occurred, the System issues orders 200 to set an emergency posture throughout appropriate areas.

The emergency posture includes stopping the flow of flammables and, to the maximum extent possible, drawing them back from pipelines. Also ground transportation and air transportation into the area is halted, and bridges are closed to oncoming traffic. Trains will be stopped where they are unless they are leaving the area. Electrical power is re-routed locally with a priority to busses supporting earthquake defense, and any chargeable sources are charged or activated. A priority tap on state, regional, or national power grids is activated as appropriate. All earthquake defenses with arming switches that require being set in an armed position prior to activation are armed. Where fire fighting systems require the charging of local storage or the generation of suppressive gasses, these are activated also. This includes systems like Kotliar's hyperbaric hypoxic fire escape system. All the local command and control systems are confirmed to be online and synchronized. Warnings are sent locally and to higher emergency response headquarters.

As the earthquake advances it is depleted and reconfigured by natural and man-made forces, many of which will overlap. For simplicity the timeline depicts the reduction in the shock threat first by the refractor channels and the passive dissipation chambers 202. Then it shows the change in the character of the waves in magnitude or timing by the wave slicers and the active dissipation chambers 204. This convention is used in the diagram because it is necessary for this Application to portray a four dimensional sequence in two dimensions. If the fault is directly under the city, and the passive dissipation chambers are extensive, massive depletion may be achieved in both the S-H and S-V waves because they both would be moving as horizontal components which cannot cross the liquid in the chambers.

Within the command center the cycle continues. At time $t_2$ 206 the Automated Command and Control System commences the active defense 208. It empowers the local command and control systems to act as autonomously as has been planned for and prescribed in advance in the overall strategy. It updates predictions of the arrival time and wave characteristics of the inbound waves as they approach the separate active dissipation chambers and fires the counter shock mechanisms as appropriate. It causes the levitation and structure motion control systems to be activated. It commences active detection and fighting of fires.

At time $t_3$ 210 the earthquake reaches the defended area 212. By this time the magnitude of the earthquake shock has been reduced to M4 or less, levels of energy reasonably within traditional design protection capabilities. Local systems conduct terminal defense, by traditional structural defenses augmented the levitation and control systems and the enhanced fire fighting capabilities.

At time $t_4$ 214 the earthquake main shaking has passed, and the command center activates the recovery phase 216. Levitated structures are restored to their sites as soon as possible to reduce the extraordinary demand on the power system. Some buildings that have drifted may have to continue to be levitated or to be temporarily deposited with a very light footprint until they can be restored to their correct site. Fire suppression continues and expands while search and rescue begins. Integrity checks are run on pipelines, rail systems, roadways, bridges, and runways. As soon as integrity has been confirmed each is restored to operation. The defenses are reconstituted to the extent their designs permit, and the status of the whole system is assessed. Repair and replenishment operations are commenced.

This preferred embodiment is nominal. Many others are envisionable, and in reality each of the defense systems will be custom developed for the area to be protected.

I claim:

1. An earthquake defense system comprising:

an underground chamber disposed completely below the surface of the earth and substantially filled with a material having a significantly different speed for seismic waves than the ambient material;

wherein the underground chamber generally fonns a channel having a first end and a second end, and wherein the underground chamber is configured such that, when a seismic wave directed generally toward a defended area impinges the first end of the underground chamber, at least a portion of the seismic wave is refracted generally in a direction away from the defended area and channeled toward the second end of the underground chamber in a direction generally away from the defended area.

2. The earthquake defense system of claim 1, wherein the underground chamber is substantially filled with a material having a lower speed for seismic waves than the ambient material.

3. The earthquake defense system of claim 1, wherein the underground chamber is substantially filled with a material having a higher speed for seismic waves than the ambient material.

4. The earthquake defense system of claim 1, wherein the second end of the underground chamber is configured to disperse a seismic wave exiting the channel through the second end.

5. The earthquake defense system of claim 4, wherein the second end of the channel is shaped such that the second end disperses the seismic wave by refracting the seismic wave outward over a quadrant larger than a rectangular termination would induce.

6. The earthquake defense system of claim 1, wherein the underground chamber is configured to refract the impinging seismic wave in a horizontal plane away from the defended area.

7. The earthquake defense system of claim 1, wherein the underground chamber is configured to refract the impinging seismic wave in a vertical plane away from the defended area.

8. The earthquake defense system of claim 1, wherein the underground chamber is configured to refract and channel P-waves.

9. The earthquake defense system of claim 1, wherein the underground chamber is configured to channel at least a portion of the impinging seismic wave generally toward a natural channel leading away from the defended area.

10. The earthquake defense system of claim 1, wherein the underground chamber is configured to channel at least a portion of the impinging seismic wave generally toward a natural feature that dissipates or disperses the portion of the seismic wave.

11. The earthquake defense system of claim 10, wherein the natural feature is an underground water formation.

12. The earthquake defense system of claim 1, wherein the underground chamber is configured to channel at least a portion of the impinging seismic wave generally toward a dissipation chamber configured to dissipate the wave energy of the seismic wave.

13. The earthquake defense system of claim 12, wherein the dissipation chamber is configured to dissipate at least a portion of the seismic wave's energy by generating spall within the chamber when the seismic wave interacts with the dissipation chamber.

14. The earthquake defense system of claim 13, wherein the dissipation chamber is at least partially filled with a fluid to increase the resistance of the spall as the spall moves within the dissipation chamber when the wave interacts with the dissipation chamber.

15. The earthquake defense system of claim 12, wherein the dissipation chamber comprises a chamber at least partially filled with a fluid and comprising ej ecta contained therein, wherein the dissipation chamber is configured such that an impinging seismic wave causes the ejecta to move through the fluid and convert wave energy into kinetic or thermal energy.

16. The earthquake defense system of claim 12, wherein the dissipation chamber comprises a chamber at least partially filled with a fluid and comprising a counter shock generator.

17. The earthquake defense system of claim 1, further comprising a plurality of seismic wave reflectors lining one side of the underground chamber, wherein the shape and materials of the wave reflectors foster internal reflection of at least a portion of the seismic wave channeled through the underground chamber.

18. The earthquake defense system of claim 17, wherein the seismic wave reflectors line the side of the underground chamber that is closest to the defended area.

19. The earthquake defense system of claim 1, wherein the underground chamber is buried at least 100 meters below the defended area.

20. The earthquake defense system of claim 1, wherein the underground chamber is buried at least 2000 meters below the defended area.

21. A method for defending an area from seismic waves, the method comprising:

providing an underground chamber completely below the surface of the earth, the underground chamber generally defining a channel having a first end and a second end;

substantially filling the underground chamber with a material having a significantly different speed for seismic waves than the ambient material; and configuring the underground chamber to: receive at the first end at least a portion of a seismic wave, refract the portion of the seismic wave generally in a direction away from the defended area, and channel the portion of the seismic wave generally toward the second end of the underground chamber in a direction away from the defended area.

22. The method of claim 21, wherein providing an underground chamber comprises excavating a substantially enclosed underground area.

23. The method of claim 21, wherein providing an underground chamber comprises constructing an underground channel wherein the second end terminates in a naturally occurring channel that extends away from the defended area.

24. The method of claim 21, wherein configuring the underground chamber comprises configuring the shape of the chamber such that a seismic wave coming from an assumed direction and impinging the first end is refracted away from the defended area in a horizontal plane.

25. The method of claim 21, wherein configuring the underground chamber comprises configuring the shape of the chamber such that a seismic wave coming from an assumed direction and impinging the first end is refracted away from the defended area in a vertical plane.

26. The method of claim 21, wherein substantially filling the underground chamber with a material having a significantly different speed for seismic waves than the ambient material comprises filling the underground chamber with a material that has a lower speed for seismic waves than the ambient material.

27. The method of claim 21, further comprising:

configuring the second end of the channel such that a seismic wave exiting the channel through the second end is dispersed.

28. The method of claim 21, further comprising:

constructing a dissipation chamber proximate the second end of the channel, the dissipation chamber configured to dissipate the wave energy of the seismic wave, wherein constructing a dissipation chamber comprises providing a chamber configured to generate spall to disperse the earthquake energy as kinetic energy when the seismic wave interacts with the dissipation chamber.

29. The method of claim 21, wherein the underground chamber is buried at least 100 meters below the surface of the defended area.

30. The method of claim 21, wherein the underground chamber is buried at least 2000 meters below the defended area.

* * * * *

UNITED STATES PATENT AND TRADEMARK OFFICE

CERTIFICATE OF CORRECTION

PATENT NO. : 7,234,897 B2
APPLICATION NO. : 11/317402
DATED : June 26, 2007
INVENTOR(S) : Conroy It is certified that error appears in the above-identified patent and that said Letters Patent is hereby corrected as shown below:

Column 26,

Line 7, “fonns” should read --forms--.

Column 27,

Line 6, “ej ecta” should read --ejecta--.

Signed and Sealed this

Eighteenth Day of March, 2008

JON W. DUDAS
*Director of the United States Patent and Trademark Office*